US010029820B2

(12) United States Patent
Van Doorn et al.

(10) Patent No.: US 10,029,820 B2
(45) Date of Patent: Jul. 24, 2018

(54) TRANSPORT AID DEVICE AND METHOD FOR THE USE THEREOF

(71) Applicant: Synergie-Invest GmbH & Co. KG, Neuenrade (DE)

(72) Inventors: Glenn Van Doorn, AR Wintelre (NL); Frank Maiworm, Neuenrade (DE)

(73) Assignee: Synergie-Invest GmbH & Co. KG, Neuenrade (DE)

( * ) Notice: Subject to any disclaimer, the term of this patent is extended or adjusted under 35 U.S.C. 154(b) by 0 days.

(21) Appl. No.: 15/314,402

(22) PCT Filed: Mar. 31, 2015

(86) PCT No.: PCT/EP2015/057099
§ 371 (c)(1),
(2) Date: Nov. 28, 2016

(87) PCT Pub. No.: WO2015/180870
PCT Pub. Date: Dec. 3, 2015

(65) Prior Publication Data

US 2017/0190464 A1 Jul. 6, 2017

(30) Foreign Application Priority Data

May 28, 2014 (DE) ..... 10 2014 007 905
Oct. 2, 2014 (DE) ..... 10 2014 014 667

(51) Int. Cl.
*B65D 19/38* (2006.01)
*B65D 19/06* (2006.01)
*B65D 19/00* (2006.01)

(52) U.S. Cl.
CPC ..... *B65D 19/385* (2013.01); *B65D 19/0095* (2013.01); *B65D 19/06* (2013.01);
(Continued)

(58) Field of Classification Search
CPC ..... B65D 2519/00935; B65D 19/38
(Continued)

(56) References Cited

U.S. PATENT DOCUMENTS 2,728,544 A * 12/1955 Ayre ..... B65D 19/385 108/53.5
2,926,792 A 3/1960 Seiz
(Continued)

FOREIGN PATENT DOCUMENTS

CA 2 817 649 A1 5/2012
CN 103237733 A 8/2013
(Continued)

OTHER PUBLICATIONS

International Search Report of International Application No. PCT/EP2015/057099 dated Jun. 9, 2015, 6 pages.
(Continued)

*Primary Examiner* — Jose V Chen
(74) *Attorney, Agent, or Firm* — Fay Sharpe LLP

(57) ABSTRACT

A transport aid device for at least two pallets, which each include a loading base that is oriented substantially horizontally in use, includes first and second supporting devices that each include at least one connecting element for mechanically connecting the supporting apparatus to at least the first pallet and two supporting bars which extend substantially in a vertical direction in use, each having a first end which forms an upper end of the supporting bar during transport. Two retaining elements are each arranged at a first end of one of the supporting bars. Each of the retaining elements is designed in a use position to retain or support the second of the two pallets in a vertically spaced position from the first pallet.

20 Claims, 24 Drawing Sheets

Figure 1:
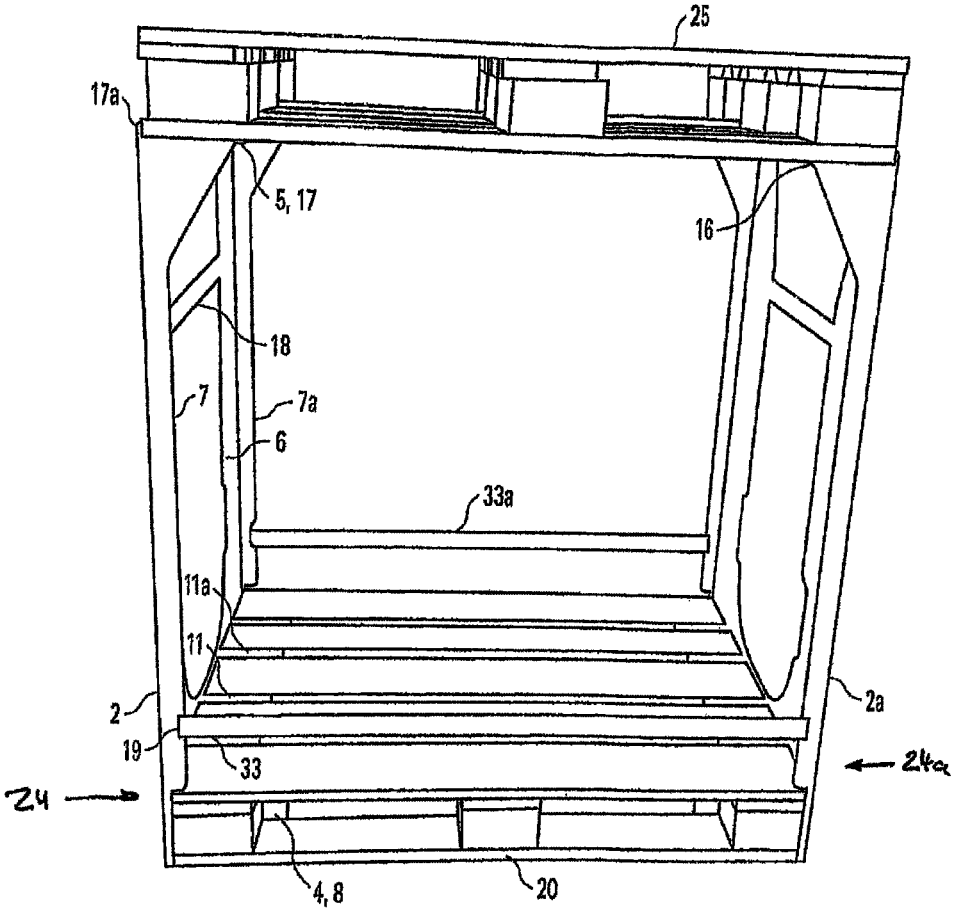

(52) U.S. Cl.
CPC .... *B65D 19/38* (2013.01); *B65D 2519/00029* (2013.01); *B65D 2519/00273* (2013.01); *B65D 2519/00582* (2013.01)

(58) Field of Classification Search
USPC ..... 108/53.1, 91, 53.3, 53.5, 51.11
See application file for complete search history.

(56) References Cited

U.S. PATENT DOCUMENTS 2,941,772 A * 6/1960 Thayer ..... A47B 57/14 108/187
3,091,195 A * 5/1963 Kenyon ..... B65D 19/06 108/53.5
3,327,654 A * 6/1967 Henry ..... B65D 19/12 108/53.1
3,998,169 A * 12/1976 Koch ..... B65D 19/16 108/53.5
4,165,806 A * 8/1979 Cayton ..... B65D 19/38 108/53.1
4,491,076 A * 1/1985 Forshee ..... B65D 19/18 108/53.1
4,703,702 A * 11/1987 Speicher ..... B65D 19/385 108/52.1
5,345,879 A * 9/1994 Maillard ..... B65D 19/12 108/53.1
D376,889 S * 12/1996 Pilla ..... D34/38
5,598,787 A * 2/1997 Pronk ..... B65D 19/385 108/51.3
5,918,551 A * 7/1999 Liu ..... B65D 19/10 108/53.1
6,202,569 B1 * 3/2001 Bailey ..... B65D 19/0026 108/53.1
6,244,194 B1 * 6/2001 Salmanson ..... A47B 5/22 108/107
6,286,792 B1 * 9/2001 Best ..... B65D 19/08 108/53.1
6,405,880 B1 * 6/2002 Webb ..... A47F 1/12 108/107
6,463,863 B1 * 10/2002 Ishikawa ..... B65D 19/385 108/53.1
7,802,526 B2 * 9/2010 Brady ..... B65D 19/12 108/53.5

FOREIGN PATENT DOCUMENTS

| | | | |
|---|---|---|---|
| DE | 7732613 | U1 | 3/1978 |
| DE | 10 2005 051347 | B3 | 2/2007 |
| DE | 10 2010 000535 | A1 | 8/2011 |
| DE | 10 2014 007905 | A1 | 12/2015 |
| DE | 10 2014 014667 | A1 | 4/2016 |
| EP | 2 357 142 | A1 | 8/2011 |
| EP | 2 733 085 | A1 | 5/2014 |
| GB | 1 137 244 | A | 12/1968 |
| WO | WO 2015/055206 | A1 | 4/2015 |

OTHER PUBLICATIONS

International Preliminary Report on Patentability of International Application No. PCT/EP2015/057099 dated Nov. 29, 2016, 11 pages (English Translation).

* cited by examiner

TRANSPORT AID DEVICE AND METHOD FOR THE USE THEREOF

The present invention relates to a transport aid device and to a method for using said transport aid device. The present invention relates in particular to a transport aid device which is suitable for improving the transport of articles which are transported on pallets and which will therefore hereinafter be referred to as pallet goods.

The entire content of the priority applications DE 10 2014 007 905 and DE 10 2014 014 667 is hereby incorporated by reference into the present application.

It is known, and generally customary, for articles which cannot be transported as mass goods or piece goods or the like to be transported on pallets, for example on heavy goods vehicles, in containers, in loading spaces of ships, and in aircraft. Here, it is sought to utilize the loading space as effectively as possible with regard to transportation costs.

If a pallet of said type is set down for example onto the base of a heavy goods vehicle body (normally also referred to as box), the space situated above the pallet cannot be further utilized for transport. This is possible if the articles situated on the pallet, by way of exception, are stable enough, and shaped such that, a second pallet can be set down directly on top of said articles. In the case of sensitive articles, however, the load capacity of the heavy goods vehicle body can be only insufficiently utilized.

It is an object of the invention to provide a device and a method for the more economical transport of pallet goods.

Said object is achieved according to the invention by way of the teaching of the independent claims. The subclaims relate to preferred refinements of the invention.

According to a first aspect of the invention, the transport aid device is provided for at least two pallets. The pallets have a loading base which is oriented substantially horizontally in a usage position during transport. The transport aid device has a first support device and a second support device for supporting at least one of the pallets. Both of these support devices have at least one connecting element for the mechanical, in particular positively locking and/or non-positively locking, connection of the respective support device to at least the first, in particular the lower, pallet. Both support devices have in each case at least two support beams which, in the usage position during transport, extend substantially in a vertical direction. Each of the support beams has a first end which, during transport, forms the upper end thereof. At least two holding elements are connected, in particular in integrally bonded fashion, in each case to a first end of one of the at least two support beams. Each of the holding elements is provided for, in the usage position during transport of the two pallets, holding or supporting the second of said pallets with a vertical spacing to the first pallet.

By way of the transport aid device according to the invention, it is possible, in particular in the usage position during transport,

- for a weight force from the second pallet to be accommodated substantially entirely by the support devices, in particular by the holding elements and support beams thereof, and/or
- for the second of said pallets to be held or supported with a vertical spacing to the first pallet, and/or
- for the second pallet to be held or supported above the first pallet, without the second pallet lying on top of the pallet goods of the first pallet, and/or

- in particular if the surface of the pallet goods of the first pallet is uneven or sensitive to pressure, for the space above the first pallet goods to be utilized for the second pallet, and/or
- for the space between the pallet goods of the first pallet and an upper delimitation of the loading space to be utilized for the second pallet.

The invention solves the problem of the inadequate space utilization by pallets which are loaded only to a relatively low height by virtue of the fact that available loading space can be better utilized. The underlying object is thus achieved.

It is furthermore advantageously possible, with the transport aid device according to the invention, for damage to the pallet goods of the first pallet by the second pallet to be counteracted.

In the context of the invention, a pallet is to be understood to mean a device which bears, in particular, articles, which are referred to in the present application as pallet goods. For this purpose, the pallet has at least one loading base, which is preferably of substantially rectangular form and on which the pallet goods are set down for transport. The pallet has at least one first recess for a so-called lifting means (lifting means recess), in particular for a fork of a forklift truck, a lifting carriage, lashing means of a crane, a conveying crab or load-bearing devices of a high-bay warehouse. The pallet has two oppositely situated shell surfaces which, in the usage position during transport, are arranged substantially vertically, and through which at least one of the abovementioned lifting means recesses is accessible. The pallet preferably has at least two lifting means recesses which are arranged at a predetermined angle with respect to one another, particularly preferably at an angle of 90° or 0°. At predetermined positions of the loading base, there are preferably arranged spacers which serve in particular for spacing the loading base of the pallet apart from the base of a storage hall, of a rack or of a freight room of a transportation means. It is preferable for in each case one spacer to be arranged at three, four or more positions below the loading base, whereby inadvertent tilting of the loading base is advantageously counteracted. It is particularly preferable for in each case one, in particular prismatic, spacer to be fastened under each corner of the loading base, which is in particular of rectangular form. It is preferably the case that two spacers delimit a recess. It is preferably the case that a base board extends through parallel to the loading base below a spacer, particularly preferably below multiple spacers. The loading base is preferably of multi-part form with multiple loading base boards, wherein two of said loading base boards can form a gap, hereinafter likewise referred to as a recess. Below, loading base, loading base boards, spacers and base boards of the pallet are also referred to as pallet body.

In the context of the invention, a support device is to be understood to mean a device which holds at least one connecting element and one holding element with a predetermined spacing to one another. The support device has two support beams, in each case with a first and a second end, which serve in particular for accommodating a force, in particular a weight force, which in the usage position during transport acts substantially along the longitudinal axis of said support beams. The support device may preferably, in the usage position during transport, be supported on the loading space base, such that a weight force from the second pallet can be supported by the loading space base. The support beam can preferably accommodate a transverse force and/or a bending moment and/or a torque resulting in particular from a weight force from the second pallet. The two support beams preferably transition into one another with at least one radius, whereby, in particular, the force flow between the support beams is improved. The support device is preferably of substantially plate-like form or formed with a bottom plate.

In the context of the invention, a connecting element is to be understood to mean a device which can connect a support device of the transport aid device to a first pallet. In particular, in the usage position during transport, the connecting element transmits a force and/or a moment between the support device and the first pallet, preferably by way of a positively locking and/or non-positively locking action. The connecting element advantageously produces a force flow between the second pallet and a lifting means. The connecting element preferably transmits the weight force from the second pallet to a lifting means which is acted on at the same time by the weight force from the first pallet, for example during the transportation of a unit composed of first and second pallet.

In the context of the invention, a holding element is to be understood to mean a device which serves for supporting a second pallet. Here, the holding element temporarily accommodates in particular a weight force from the second pallet and introduces said weight force into the support device. The holding element advantageously at least intermittently accommodates transverse forces from the weight of the second pallet and transmits these to the support device. During transport, the holding element is connected, in particular in integrally bonded fashion, to the support device, in particular to the first end of one of the support beams. In particular during transport, the holding element has a predetermined spacing to the first end of the support device and/or to the connecting element. The spacing between the holding element and the connecting element is preferably dependent on the height of the available loading space. The holding element preferably has one of the mechanical connecting means discussed below.

In the context of the invention, a mechanical connecting means is to be understood to mean a means for the mechanical, in particular detachable, connection of a first part of the transport aid device to a second part of the transport aid device. The mechanical connecting means is preferably in the form of an eyelet, bore, hole, blind hole, recess, projection, hook, pin, bolt, shaft or detent means.

Below, preferred refinements of the transport aid device will be described which may in each case be combined with one another unless expressly stated otherwise.

In a preferred refinement, one or more of the support devices has a material from a group comprising wood, plastic, metal, cardboard, steel, light metals, aluminum, alloys with aluminum, plastic, polypropylene, polyethylene. At least one of the support devices preferably has a plastic, wherein, as reinforcement fibers, use may be made of reinforcement fibers composed of glass, carbon, mineral fibers, wood fibers. The component preferably has a structure with cavities, particularly preferably a hardened foam and/or honeycomb. A hardened foam and/or a honeycomb structure is preferably equipped with at least one cover, particularly preferably with a thin-walled plate. It is particularly preferable for at least one of the support devices to be formed as a so-called sandwich plate, in which a foam layer or honeycomb layer extending substantially in a plane is connected, in particular is connected in integrally bonded fashion, on both sides to in each case one cover plate.

In a preferred refinement, the support beam has a cross section whose section moduli about two bending axes arranged at right angles to one another have a predetermined ratio. Thus, non-uniform biaxial bending under load of the support beam is counteracted by way of a force transversely with respect to the longitudinal axis and/or by way of a bending moment. The stability of the transport aid device designed in this way during transport is advantageously improved. The ratio of the section moduli is preferably between 2 and 0.5, more preferably between 1.5 and 0.75, more preferably between 1.1 and 0.9. At least one of the support beams may have a rectangular, circular, elliptical, trapezoidal cross section. In particular, at least one of the support beams is in the form of a tube, flat bar, profiled bar, I-beam, T-beam, L-beam. It is preferable for at least one limb of one of the support beams to have recesses, in particular for weight saving purposes or for detachable mechanical connection to one of the connecting struts described below.

In a preferred refinement, at least one first connecting projection of the connecting element extends substantially at right angles, and in the usage position substantially horizontally, out of a bottom plate of the support device, wherein the first connecting projection can engage mechanically, in particular in positively locking and/or non-positively locking fashion, into a first recess, in particular into a lifting means recess, of one of the pallets, in particular of the first pallet. The first connecting projection preferably has at least one stiffening limb and one second limb which is angled relative to the stiffening limb. The stiffening limb of the first connecting projection may in particular be supported on the loading space base during transport. The second limb of the first connecting projection may extend along the loading base and serve, during the lifting of the transport aid device, as a support for the lifting means. It is preferably the case that stiffening limbs of the first connecting projection bear, in particular during transport, against one or more of the spacers of the pallet body within one of the lifting means recesses. It is preferably the case that a second limb of the first connecting projection bears, in particular during transport, against the loading base within one of the lifting means recesses. The first connecting projection is preferably formed with an angled plate, in particular with a metal plate.

The first connecting projection preferably has two of the stiffening limbs, which are arranged substantially parallel to one another and which are spaced apart from one another by the second limb. The first connecting projection preferably has a substantially U-shaped cross section, which is particularly preferably open toward the loading space base. The first connecting projection is preferably formed with a doubly angled plate, in particular with a metal plate. The mechanical stability of the first connecting projection is advantageously improved.

The connecting element preferably has two first connecting projections which can engage into different lifting means recesses, and which for this purpose are spaced apart from one another. Thus, a weight force from the second pallet can act on the lifting means via at least one of the holding elements, one of the support beams and the second limb. It is advantageously possible for the first connecting projection to improve the mechanical connection of the support device to at least one of the pallets and/or to serve for the transmission of a weight force from the second pallet to the loading space base.

In a preferred refinement, at least one or more of the connecting elements has/have a second connecting projection which, during transport, has a vertical spacing to the first connecting projection. A section of one of the pallets, in particular the loading base of the first pallet, can be mechanically received, in particular in positively locking and/or non-positively locking fashion, between the first and second connecting projections. The second connecting projection is preferably, during transport, arranged above the first connecting projection. The second connecting projection is preferably dimensioned such that it can engage into a recess in the loading base or into a gap between two loading base boards. The second connecting projection preferably has a substantially L-shaped or U-shaped cross section, the second limb of which extends substantially parallel to the second limb of the first connecting projection. The second connecting projection is preferably formed with a doubly angled plate, in particular with a metal plate. The spacing between the second limb of the first and second connecting projections is preferably no greater than the thickness of the loading base plus a manufacturing tolerance.

It is preferably the case that at least one stiffening limb bears, during transport, against a shell surface of one of the loading base boards. The second connecting projection can advantageously improve the mechanical connection of the connecting element to at least one of the pallets.

In a preferred refinement, at least one of the first connecting projections or at least one of the second connecting projections has at least one second limb which can bear against a loading base of one of the pallets, in particular of the first pallet, and one stiffening limb, which is angled relative to the second limb and which serves for stiffening the connecting projection. The stiffening limb of the first connecting projection may advantageously be supported, in particular during transport, on the loading space base. The second limb of the first connecting projection may advantageously, in particular during transport, extend along the loading base and serve as a support for a lifting means during the lifting of the transport aid device.

In a preferred refinement, at least one of the support devices has at least one or two foot plates for supporting the first pallet. During transport, the at least one foot plate is arranged at the lower end of the support device and below the first pallet. The at least one foot plate is preferably angled out of a bottom plate of the support device. The foot plate can advantageously protect the first pallet.

It is preferably the case that at least one of the foot plates is mechanically, in particular in integrally bonded fashion, connected to a stiffening limb of the first connecting projection. The mechanical stability of the first connecting projection is advantageously improved, in particular during the lifting of the transport aid device.

In a preferred refinement, at least one stiffening rib extends out of a bottom plate of at least one of the support devices. The stiffening rib is preferably oriented substantially vertically during transport. The stiffening rib preferably extends along a section of one of the support beams and/or out of the bottom plate at an angle of approximately 90°. The stiffening rib of the support device is preferably generated by virtue of the bottom plate being folded or turned up. It is preferable for at least one of the support devices to have two such stiffening ribs which extend from opposite ends of the bottom plate and which are oriented substantially parallel to one another. The stiffening rib advantageously serves for stiffening the support device and/or one of the support beams.

In a preferred refinement, at least one or more of the holding elements has/have a first support surface, which during transport is oriented substantially horizontally and which serves for supporting the second pallet, and at least one support projection, which is angled relative to the first support surface. The first support surface is preferably supported by way of one of the reinforcement ribs or a limb of the associated support beam. The support projection serves, during transport, for counteracting an undesired, in particular horizontal, displacement of the second pallet relative to the holding element or relative to the first support surface thereof. For this purpose, the support projection extends, in sections, along a delimiting edge of the first support surface.

The support projection preferably forms an angle of between 90° and 135° with the first support surface. With a relatively large angle, the support projection can simplify the setting-down of the second pallet, by virtue of the fact that the second pallet, during the setting-down, can be guided in the direction of the first support surface by way of the support projection.

It is preferable for at least one of the holding elements to be formed with an angled metal plate, wherein the limbs of the metal plate form the first support surface and one of the support projections. The holding element formed in this way is particularly preferably in integrally bonded fashion connected to the first end of one of the support beams.

It is preferable for at least one or more of the holding elements to have in each case two of said support projections, which extend along different delimiting edges, arranged in particular at right angles with respect to one another, of the first support surface. Alternatively, a section of the first end can counteract an undesired displacement of the second pallet relative to the support device or the first support surface thereof, by virtue of the support surface, during transport, being arranged at least 10 mm below the first end.

It is advantageously possible for the two support projections to guide the second pallet, during the setting-down in a vertical direction or Z direction of a three-dimensional Cartesian coordinate system, both in the X direction and in the Y direction. It is advantageously possible for the two support projections to counteract an undesired displacement of the second pallet both in the X direction and in the Y direction relative to the holding element or the first support surface thereof.

In a preferred refinement, two of the holding elements of the same support device are connected, in particular in integrally bonded fashion, to one another by way of a second stabilizing strut. The second stabilizing strut preferably has the same material as the holding elements. The second stabilizing strut preferably extends between the holding elements or the first support surfaces thereof, in particular for a small space requirement. The second stabilizing strut preferably extends substantially horizontally during transport. The second stabilizing strut can advantageously improve the mechanical stability of the support device, in particular can counteract a relative movement of the two holding elements with respect to one another. It is advantageously possible for the second stabilizing strut to be utilized as a handle and to facilitate the handling of the support device, in particular during the connection of the connecting element to the first pallet.

In a preferred refinement, the two support beams of at least one of the support devices are connected, in particular in integrally bonded fashion, to one another by way of a first stabilizing strut. The first stabilizing strut preferably has the same material as the bottom plate of the support device. It is preferable for one of the first stabilizing struts to extend in a plane of the bottom plate, in particular for a small space requirement, and to connect the two support beams. It is preferable for one of the first stabilizing struts to extend, during transport, substantially horizontally, adjacent to the first ends of the two support beams, and to connect the two first ends. It is preferable for one of the first stabilizing struts to extend substantially horizontally during transport, and to connect the two holding elements of the support device. The first stabilizing strut can advantageously improve the mechanical stability of the support device, in particular can counteract a relative movement of the two support beams relative to one another. It is advantageously possible for the first stabilizing strut to be utilized as a handle and to facilitate the handling of the support device, in particular during the connection of the connecting element to the first pallet.

In a preferred refinement, the bottom plate of at least one of the support devices has one or more recesses which can accommodate in each case one connecting section of one of the holding elements, of one of the first stabilizing struts, of one of the second stabilizing struts, of one of the first connecting projections or of one of the second connecting projections, hereinafter jointly referred to as attachment parts. It is preferably the case that in each case one of said recesses and one of the connecting sections form a plug-type connection. It is preferably the case that a stiffening limb and a second limb of at least one of the first and/or second connecting projections has in each case at least one of said connecting sections. It is preferably the case that at least one of the holding elements, in particular the support projection thereof, has at least one or two of said connecting sections. The positioning of the respective attachment part relative to the bottom plate during the production of one of the support devices, in particular also the subsequent joining of bottom plate and attachment part, is advantageously simplified.

In a preferred refinement, the transport aid device has at least one or more connecting struts for the detachable mechanical connection of the two support devices to one another. The connecting strut can subject the two support devices to a tensile force which forces the two support devices toward one another. The connecting strut is preferably formed with a metal profile, a tensile bar, a cable, a chain, a strap or a belt. The connecting strut preferably has at least one lashing means for mechanical connection to one of the support devices, to one of the support beams, or to a stiffening rib of the bottom plate of the support device. The lashing means is particularly preferably formed with a hook, eyelet, detent means or loop. The connecting strut is preferably of elastic or length-adjustable form.

The connecting strut is particularly preferably formed with a belt or strap whose ends have in each case one loop. Alternatively, the connecting strut is formed with a tensile bar, and the ends thereof are formed in each case with one of the mechanical connecting means, in particular with a hook, an eyelet, or a detent means. Alternatively, the connecting strut is of bar-like form, the second end of which has one of the mechanical connecting means, in particular a hook, an eyelet or a detent means, and whose first end, situated opposite the second end, is designed for articulated connection to one of the support devices, in particular to one of the holding elements. The connecting strut can advantageously improve the cohesion of the transport aid device.

The connecting strut is preferably designed for detachable mechanical connection to in each case one of the support beams of the two support devices. Alternatively, the connecting strut is designed for detachable mechanical connection to in each case one of the abovementioned stabilizing struts of the two support devices.

The connecting strut can advantageously improve the mechanical connection of at least the connecting element to the first pallet. The connecting strut can advantageously counteract a displacement of the first support device relative to the second support device.

In a preferred refinement, at least one of the abovementioned stiffening ribs of the bottom plate of one of the support devices has a mechanical connecting means for mechanical, in particular detachable, connection to one of the abovementioned connecting struts. The mechanical connecting means is connectable to, in particular one of the abovementioned lashing means of, the connecting strut. The mechanical connecting means is preferably in the form of an eyelet, projection, hook, pin, bolt, detent means or recess.

A preferred embodiment of the mechanical connecting means is formed with a pin, which is in particular cut out of the stiffening rib and which extends, during transport, substantially in a vertical direction and which is in particular connectable to a lashing means, in the form of a loop, of the connecting strut. It is advantageously possible for the mechanical connection between the loop and the pin to be produced and released in a short amount of time.

An alternative preferred embodiment of the mechanical connecting means is formed with two projections, which are in particular cut out of the stiffening rib and which, during transport, extend substantially in a vertical direction. During transport, one of said projections points downward, the other of said projections points upward, and a gap remains between the free ends of said projections. A lashing means, in the form of a loop, of the connecting strut can be led through said gap and placed over both projections. It is advantageously possible for the connecting strut to be connected in a more permanent manner the stiffening rib and/or to the support device.

In a preferred refinement, the transport aid device has at least one of the connecting struts, wherein a first end of the connecting strut is articulately connected to one of the holding elements of a first support device, wherein a second end, situated opposite the first end, of the connecting strut, having one of the mechanical connecting means, is detachably mechanically connectable to a first holding element of a second support device, and wherein the first holding element of the second support device has a mechanical connecting means which is complementary to the mechanical connecting means of the connecting strut.

The first end of the connecting strut preferably has a shaft. The second end of the connecting strut preferably has a particularly preferably arcuate hook. The first holding element preferably has a receiving element for the shaft of the connecting strut. The first holding element preferably has an eyelet, bore, blind hole, hole or recess. A section, which has the complementary mechanical connecting means, of the first holding element particularly preferably extends out of the first support surface, whereby at least the thickness of the connecting strut can be compensated.

It is preferably possible for the connecting strut to be reversibly transferred from a rest position, in which the connecting strut extends substantially along one of the support beams of the first support device, into a usage position, in which the mechanical connecting means is detachably connected to the first holding element of the second support device and the connecting strut extends substantially horizontally.

It is preferably the case that both the first and the second support device have in each case one of said connecting struts and in each case the first holding element.

In the preferred refinement, the cohesion of the two support devices during transport and/or in the usage position can be improved.

In a preferred refinement of the transport aid device, at least two of the support beams of a first support device are connected, in particular in integrally bonded fashion, to one another by way of a functional strut, wherein preferably, one, two or more of the connecting struts are mechanically connectable to the functional strut.

The functional strut is preferably with a profile strut. The functional strut is preferably formed with an angled profile, particularly preferably with an L-shaped profile, V-shaped profile, T-shaped profile, H-shaped profile, double-T-shaped profile, C-shaped profile, U-shaped profile or two parallel limbs. The functional strut and the bottom plate and/or support beams of the first support device preferably have materials that are in integrally bonded fashion connectable to one another. The functional strut is preferably mechanically or in integrally bonded fashion connected to the two support beams adjacent to the holding elements thereof.

The connecting strut formed with a belt or strap preferably has, at a first end, one of the mechanical connecting means, wherein the mechanical connecting means serves for detachable mechanical connection to a second support device. The connecting strut is preferably formed with a fabric strap.

The connecting strut formed with a belt or strap is preferably stored, at least in sections, on a particularly preferably spring-loaded belt roller which is mechanically connectable to the functional strut. Alternatively, the connecting strut is in the form of a tension belt, the second end of which is mechanically connectable to the functional strut.

The at least one connecting strut formed with a belt or strap is preferably reversibly transferable into a usage position in which the connecting strut is detachably mechanically connected to the second support device.

In the preferred refinement, the cohesion of the two support devices during transport and/or in the usage position can be improved.

A preferred arrangement has a transport aid device according to the first aspect of the invention or according to one of the preferred refinements thereof, and has one or two pallets, wherein the first support device and the second support device are in each case mechanically connected, by way of the connecting element thereof, to the first pallet. The support beams extend in a vertical direction, and the holding elements form the upper ends of the support beams. The bottom plates of the first and of the second support device preferably bear against opposite shell surfaces of the first pallet. Said arrangement is advantageously suitable for the loading and setting-down of the second pallet without the pallet goods of the first pallet being subjected to load by the second pallet. A weight force from the second pallet can advantageously be transmitted directly by way of the support devices to the floor of a storage site or of a loading space base.

The second pallet is preferably, in particular during transport, held or supported with a vertical spacing to the first pallet by way of at least one or more of the holding elements. The pallet goods of the first pallet are advantageously not subjected to load by the second pallet.

The first support device is preferably mechanically connected to the second support device by way of at least one or two of said connecting struts. Here, the connecting strut may exert a force on the two support devices, which forces said support devices toward one another. The cohesion of the transport aid device is advantageously improved, in particular during transport.

The first support device preferably has at least one first connecting projection which extends substantially at right angles from a bottom plate of the first support device. The first connecting projection engages mechanically into a first recess or lifting means recess of the first pallet. The bottom plate bears in sections against a first shell surface of the first pallet.

The second support device preferably bears in sections against a second shell surface of the first pallet situated opposite the first shell surface of the first pallet. This arrangement is advantageously suitable for the loading and setting-down of the second pallet without the pallet goods of the first pallet being subjected to load by the second pallet. A weight force from the second pallet can advantageously be transmitted directly by way of the support devices to the floor of a storage site or of a loading space base.

It is preferably the case that one of the connecting struts is, during transport, detachably connected to the first stabilizing strut of the first support device and to the first stabilizing strut of the second support device. The cohesion of the transport aid device during transport can advantageously be improved.

A further preferred arrangement has a transport aid device according to the first aspect of the invention or according to one of the preferred refinements thereof and has a pallet, wherein the first support device lies on the loading base of the pallet, wherein the second support device lies on the first support device, and wherein the two support devices are detachably mechanically connected to the pallet, preferably by way of at least one of the connecting struts formed with a belt. The two support devices are preferably supported by the pallet such that the support devices do not extend, or extend only insignificantly, beyond the delimiting edges of the loading base. It is advantageously possible by way of this arrangement for the transport aid device to be more easily transported, loaded or stored.

According to a second aspect of the invention, a method for using a transport aid device, in particular according to the first aspect of the invention or according to one of the preferred refinements thereof, has the following steps:

S1 mechanically connecting a connecting element of a first support device of the transport aid device to a first pallet such that two support beams of the first support device extend, during transport, substantially in a vertical direction, wherein in each case a first end of the support beams is connected, in particular in integrally bonded fashion, to a holding element, S2 mechanically connecting a connecting element of a second support device of the transport aid device to the first pallet such that two support beams of the second support device extend, during transport, substantially in the vertical direction, wherein in each case a first end of the support beams is connected, in particular in integrally bonded fashion, to a holding element, S3 placing a second pallet onto one or more of the holding elements, wherein each of the holding elements is provided for, during the transport of the two pallets, holding or supporting at least the second pallet with a vertical spacing to the first pallet, preferably additionally with the step:

S4 mechanically connecting a connecting strut of the transport aid device to at least one or both support devices such that a displacement of the first support device relative to the second support device is counteracted, in particular before step S3.

Step S4 is preferably performed such that at least one of the connecting struts is connected both to a support beam or holding element of the first support device and to a support beam or holding element of the second support device (step S4').

Step S4 is particularly preferably performed with a connecting strut formed with a tension belt being subjected to tension. Alternatively, step S4 may be performed with a connecting strut, which is articulatedly connected to the first support device and which is formed with a hook, being pivoted and hooked into a mechanical connecting means of the second support device.

By way of the transport aid device according to the invention, it is possible, in particular during transport,

- for a weight force from the second pallet to be accommodated substantially entirely by the support devices, in particular by the holding elements and support beams thereof, and/or
- for the second of said pallets to be held or supported with a vertical spacing to the first pallet, and/or
- for the second pallet to be held or supported above the first pallet, without the second pallet lying on top of the pallet goods of the first pallet, and/or
- in particular if the surface of the pallet goods of the first pallet is uneven or sensitive to pressure, for the space above the first pallet goods to be utilized for the second pallet, and/or
- for the space between the pallet goods of the first pallet and an upper delimitation of the loading space to be utilized for the second pallet.

The invention solves the problem of the inadequate space utilization by pallets which are loaded only to a relatively low height by virtue of the fact that available loading space can be better utilized. The underlying object is thus achieved.

It is furthermore advantageously possible, with the transport aid device according to the invention, for damage to the pallet goods of the first pallet by the second pallet to be counteracted.

According to a third aspect of the invention, a method for using a transport aid device, in particular according to the first aspect of the invention or according to one of the preferred refinements thereof, has the following steps:

S8 placing a first support device of the transport aid device onto a loading base of a pallet, S9 placing a second support device of the transport aid device onto the first support device, in particular in such a way that the two support devices do not extend, or extend only to an insignificant extent, beyond delimiting edges of the loading base, S10 mechanically connecting the support devices to the pallet.

It is advantageously possible, after step S10, for the transport aid device to be more easily transported, loaded or stored.

Figure 2:
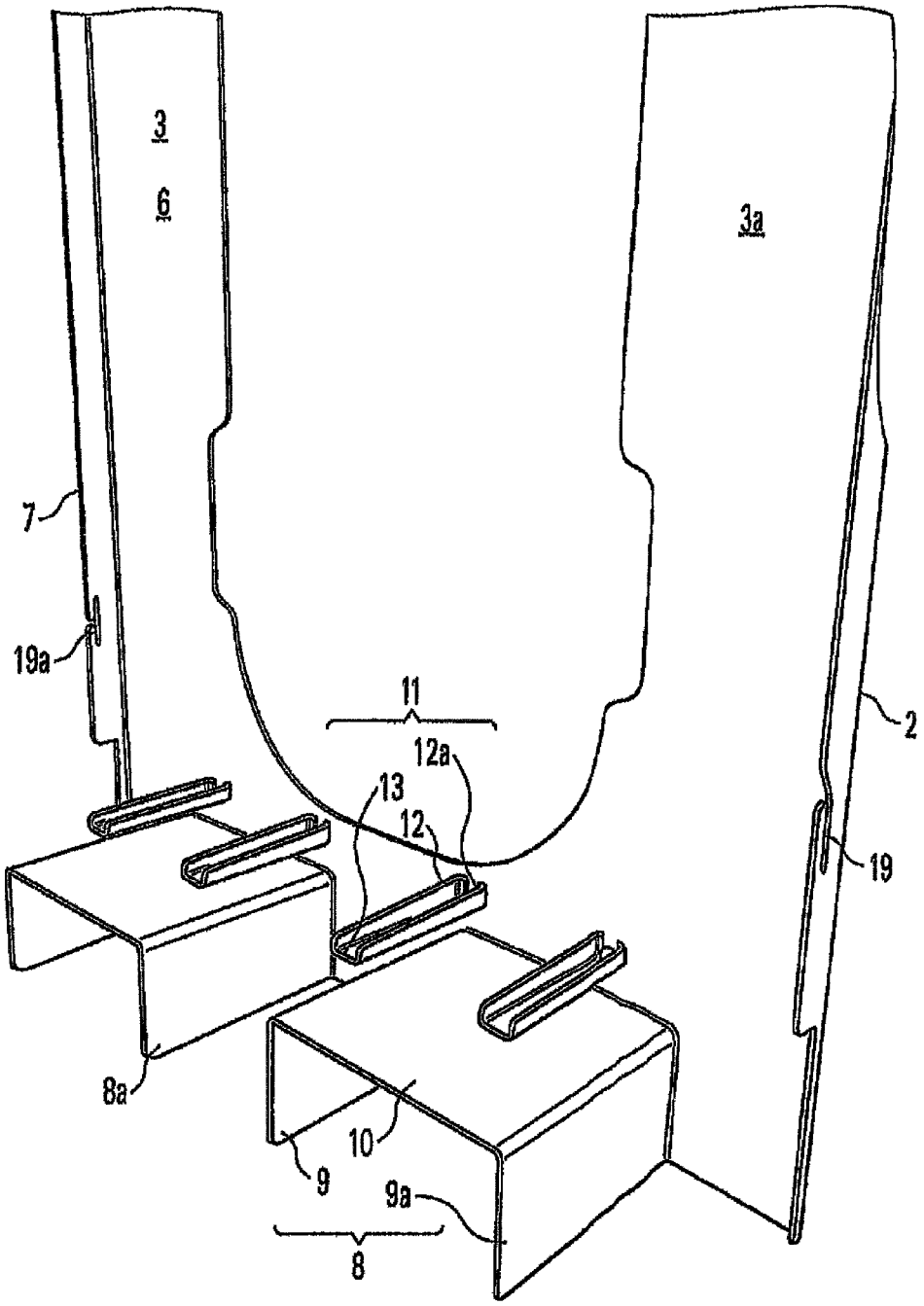
Figure 3:
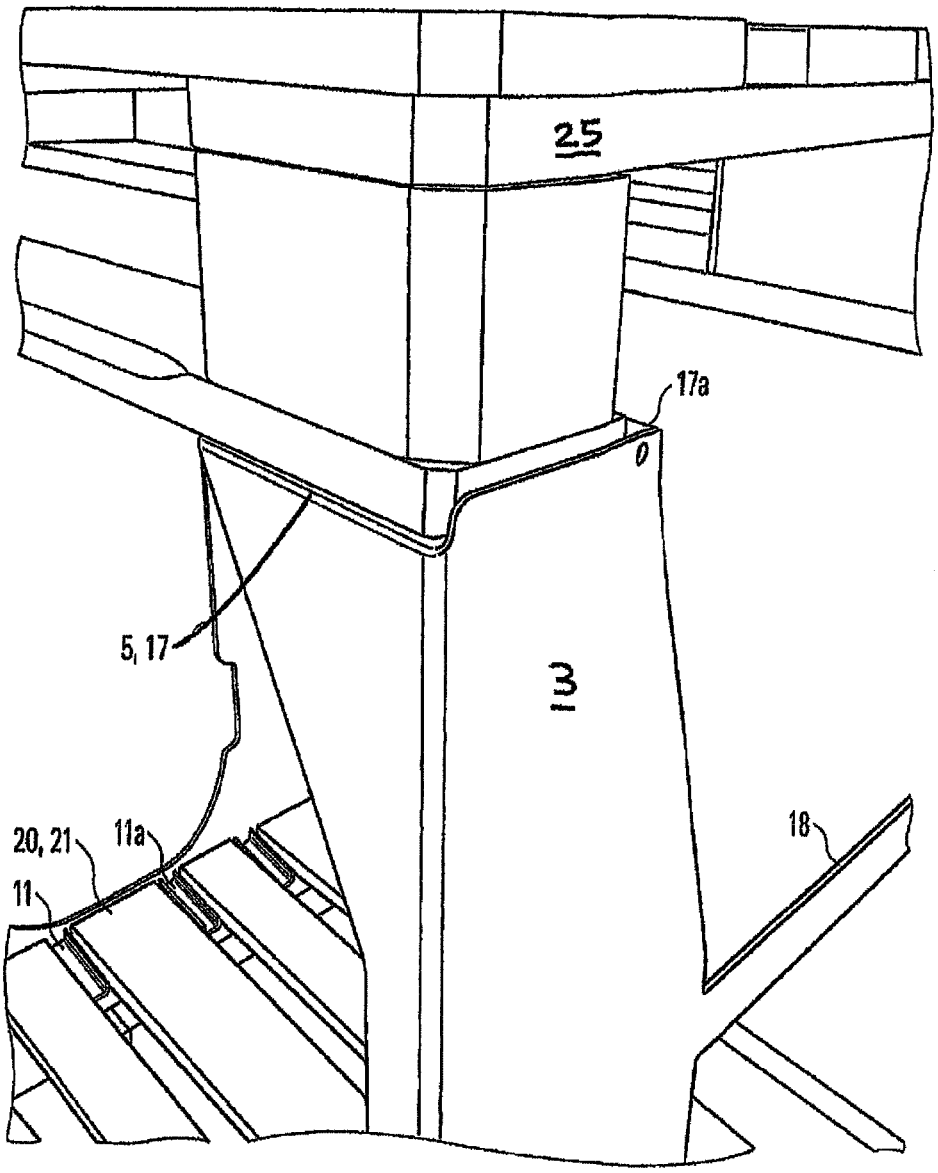
Figure 4:
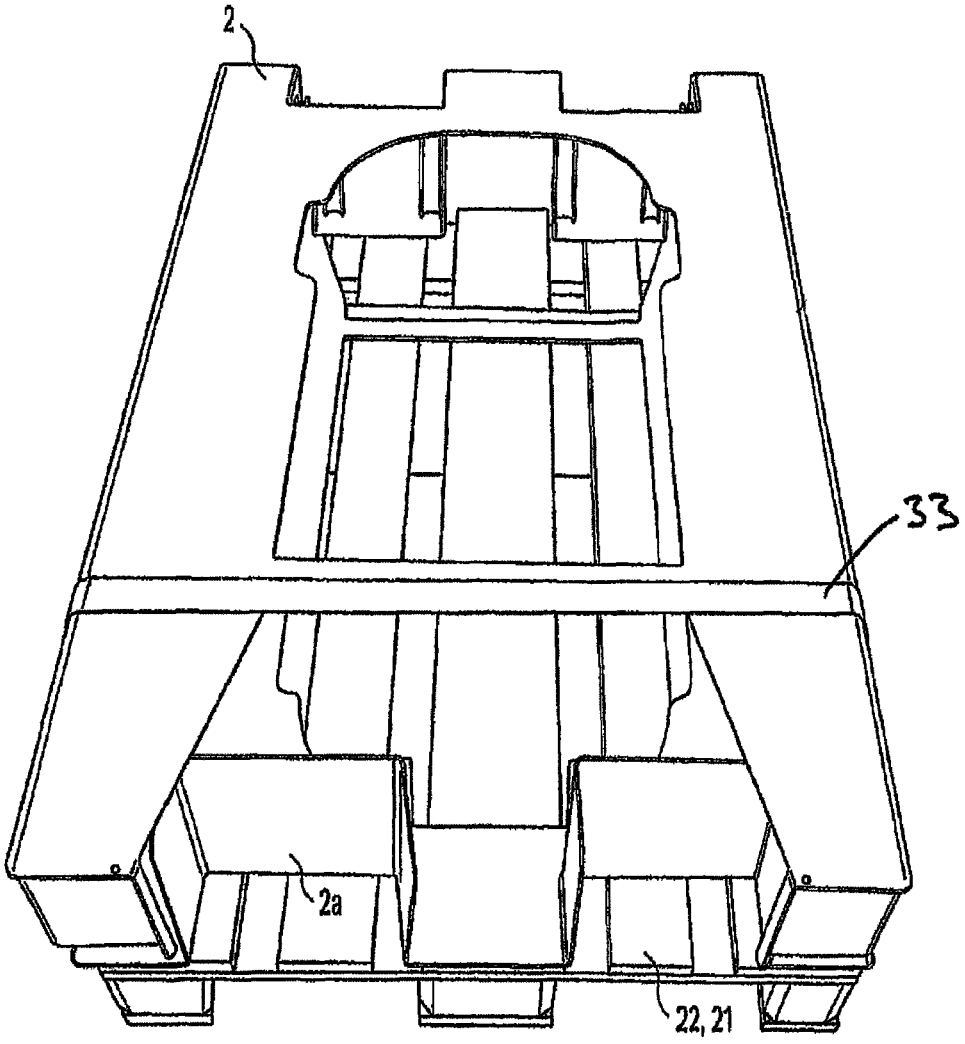
Figure 5:
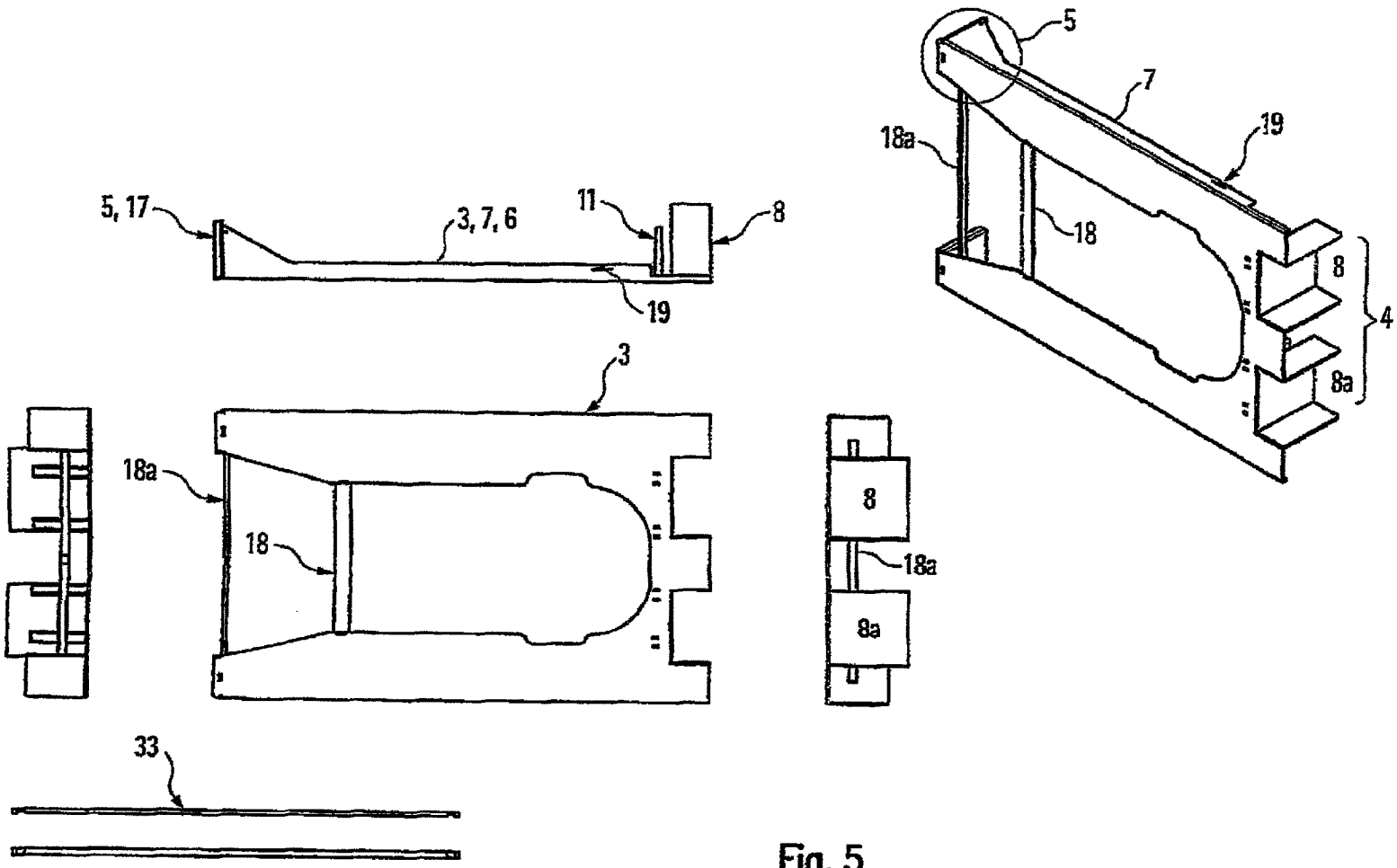
Figure 6:
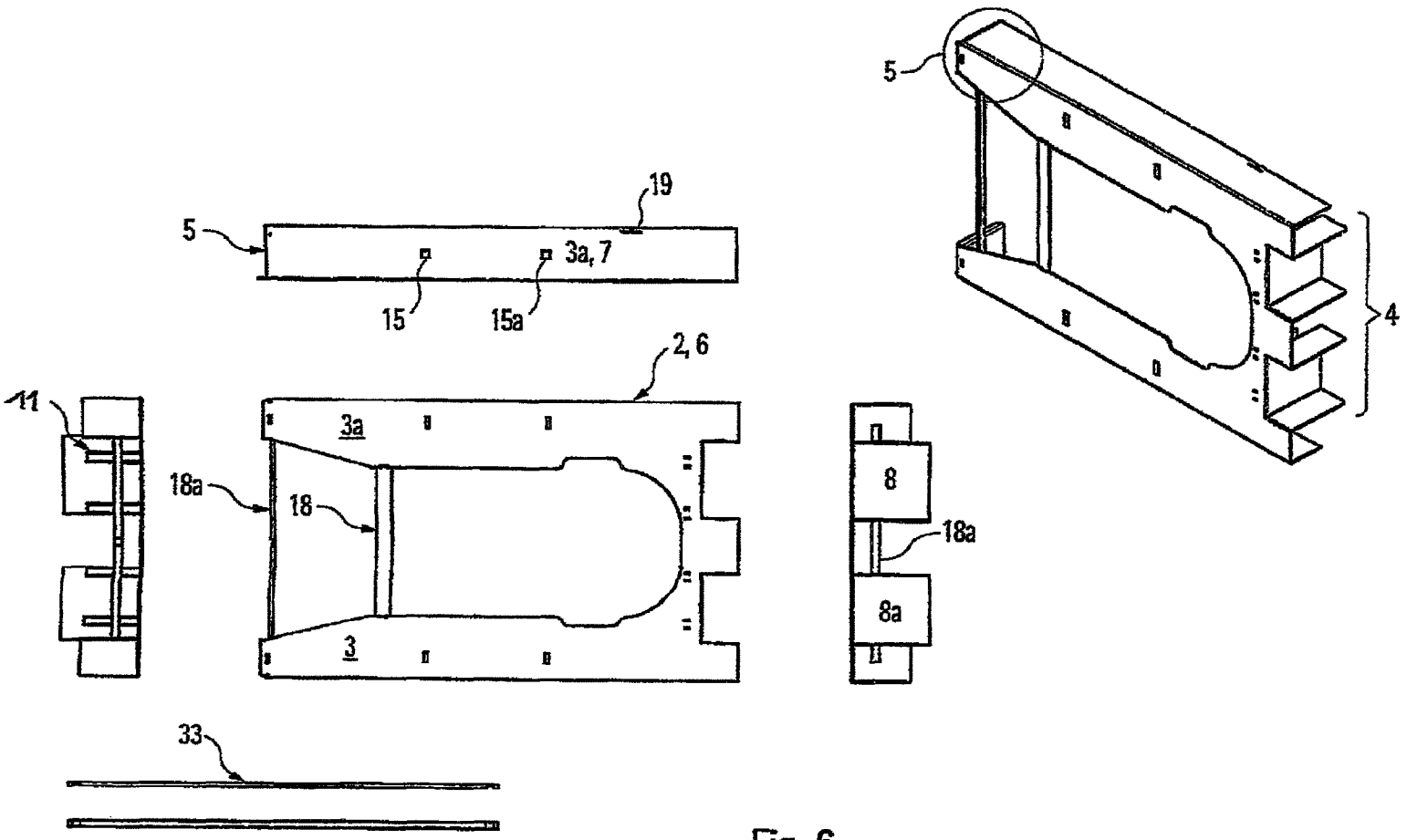
Figure 7:
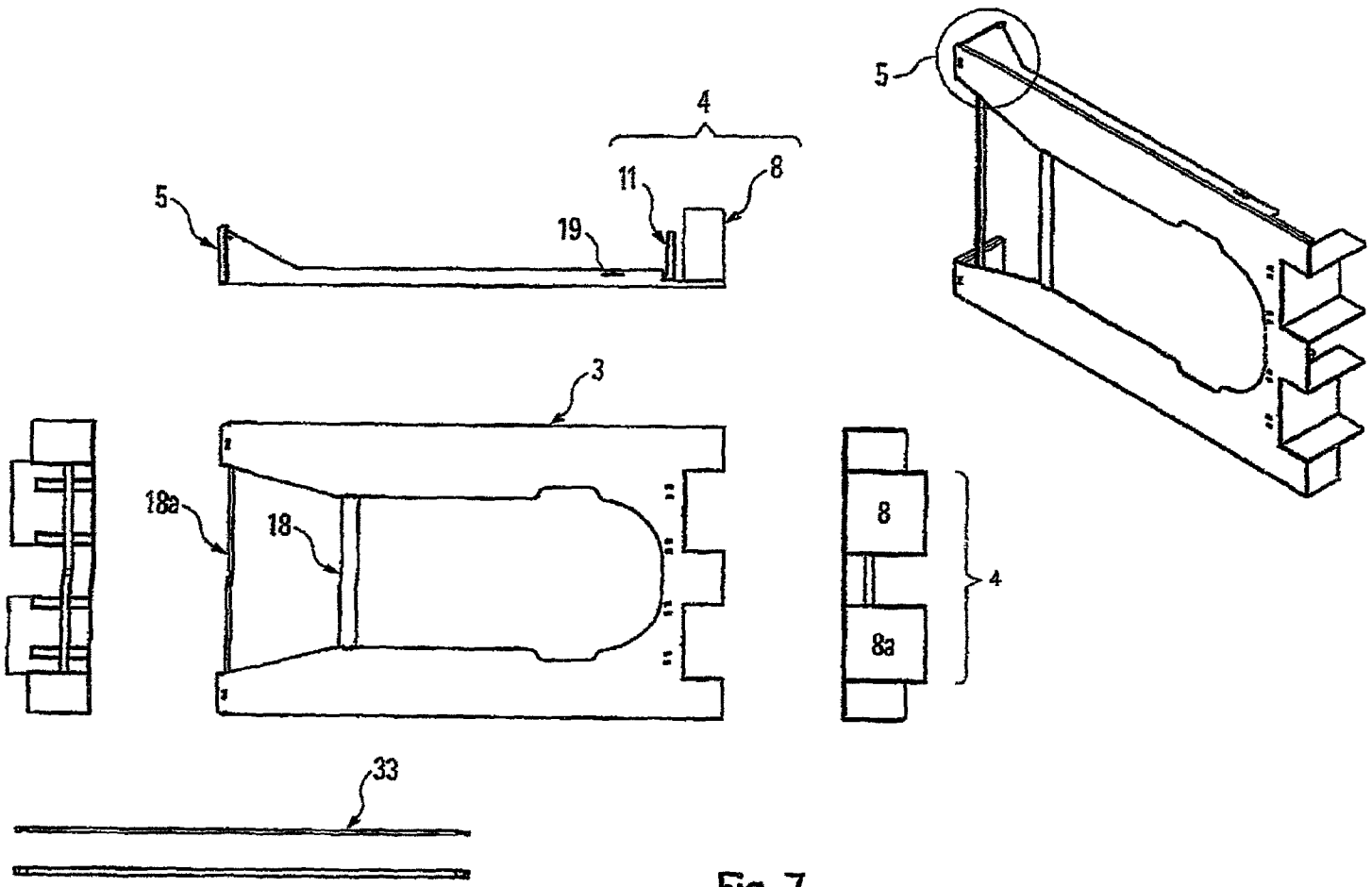
Figure 8:
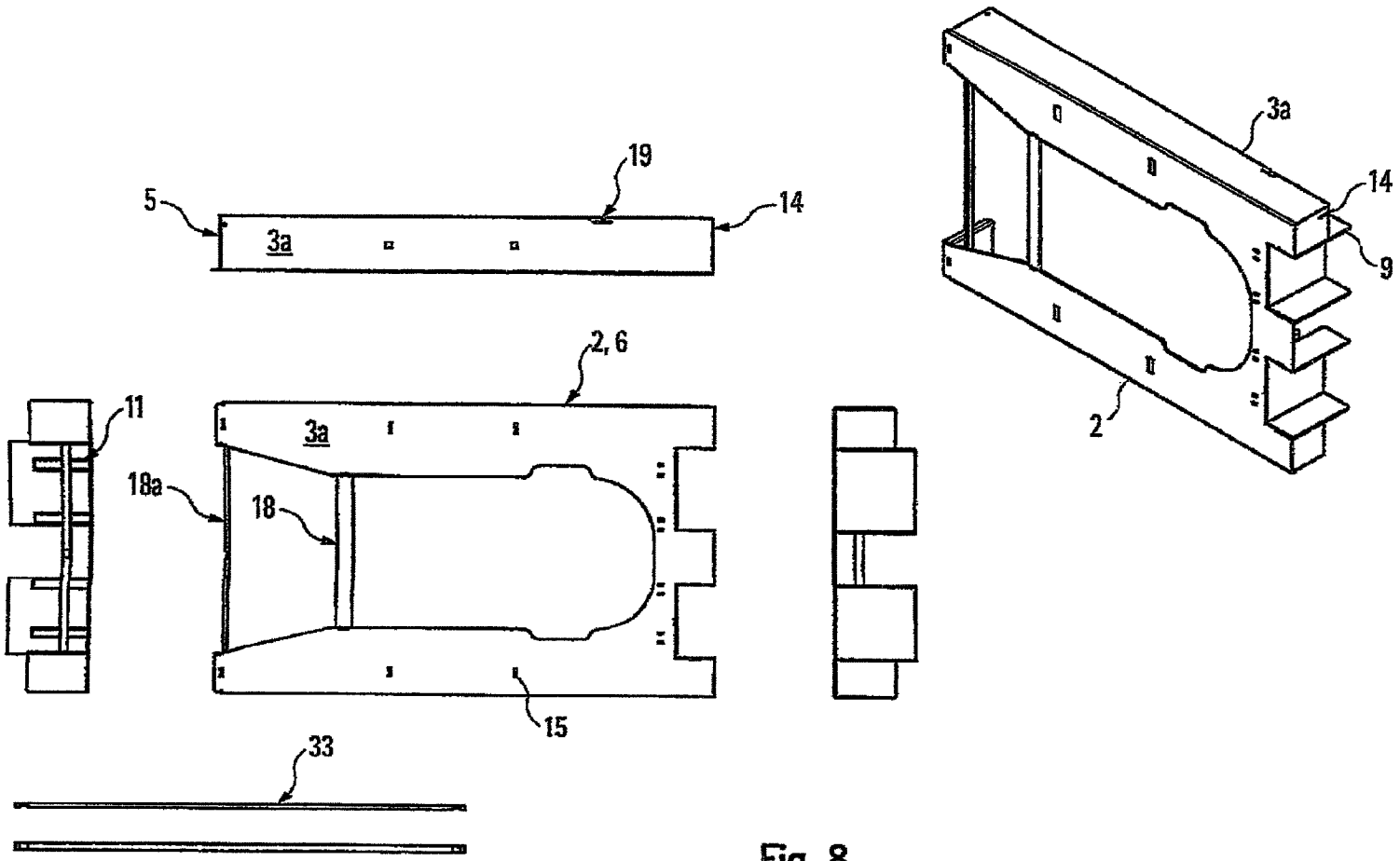
Figure 9:
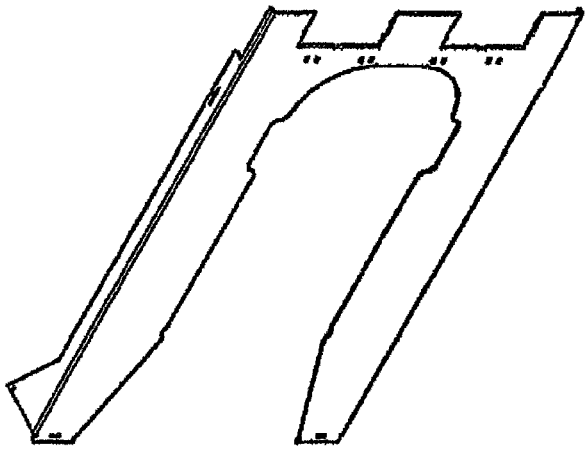
Figure 9:
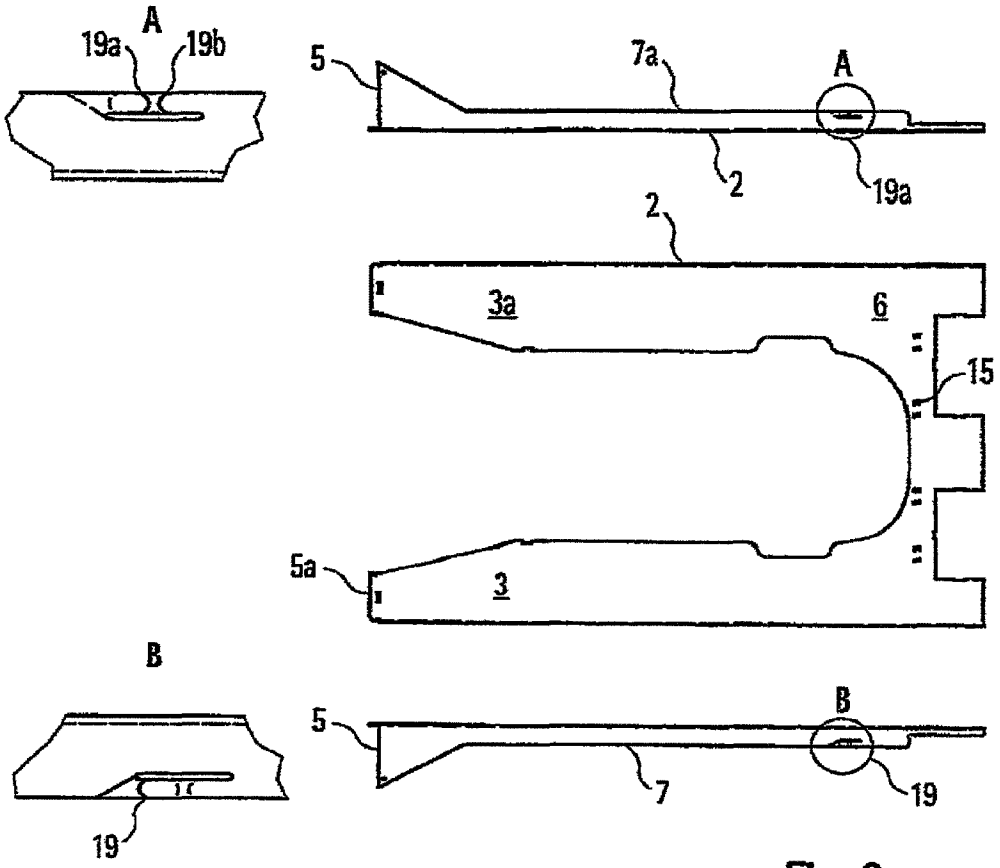
Figure 10:
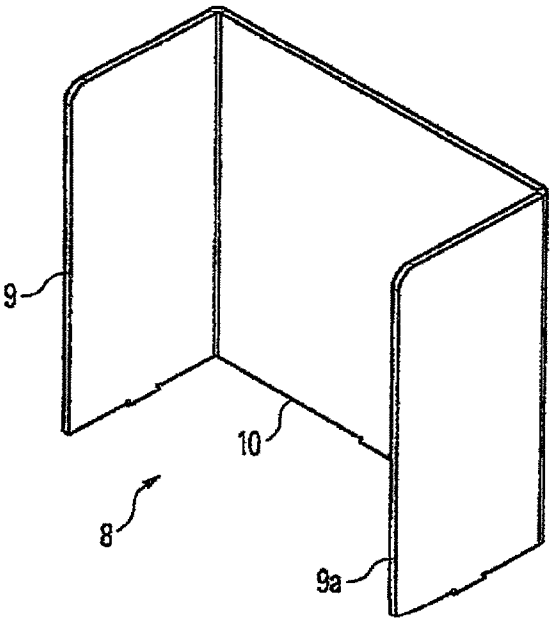
Figure 10:
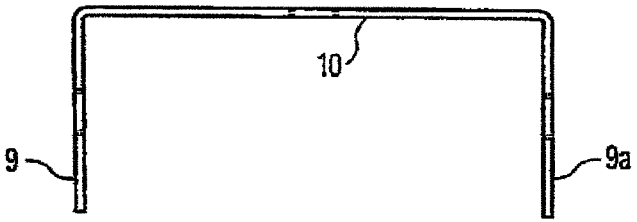
Figure 10:
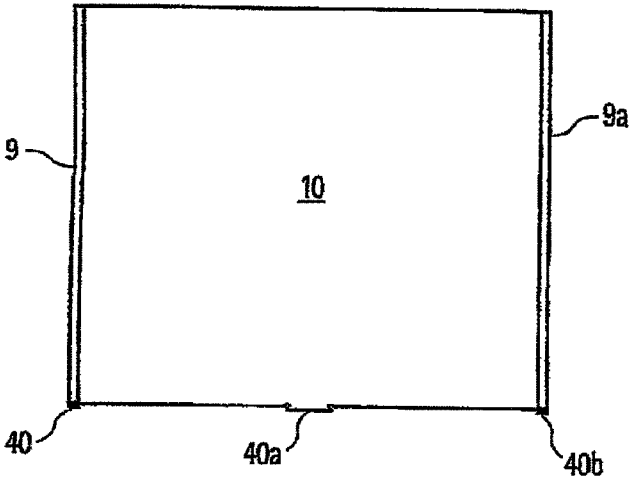
Figure 11:
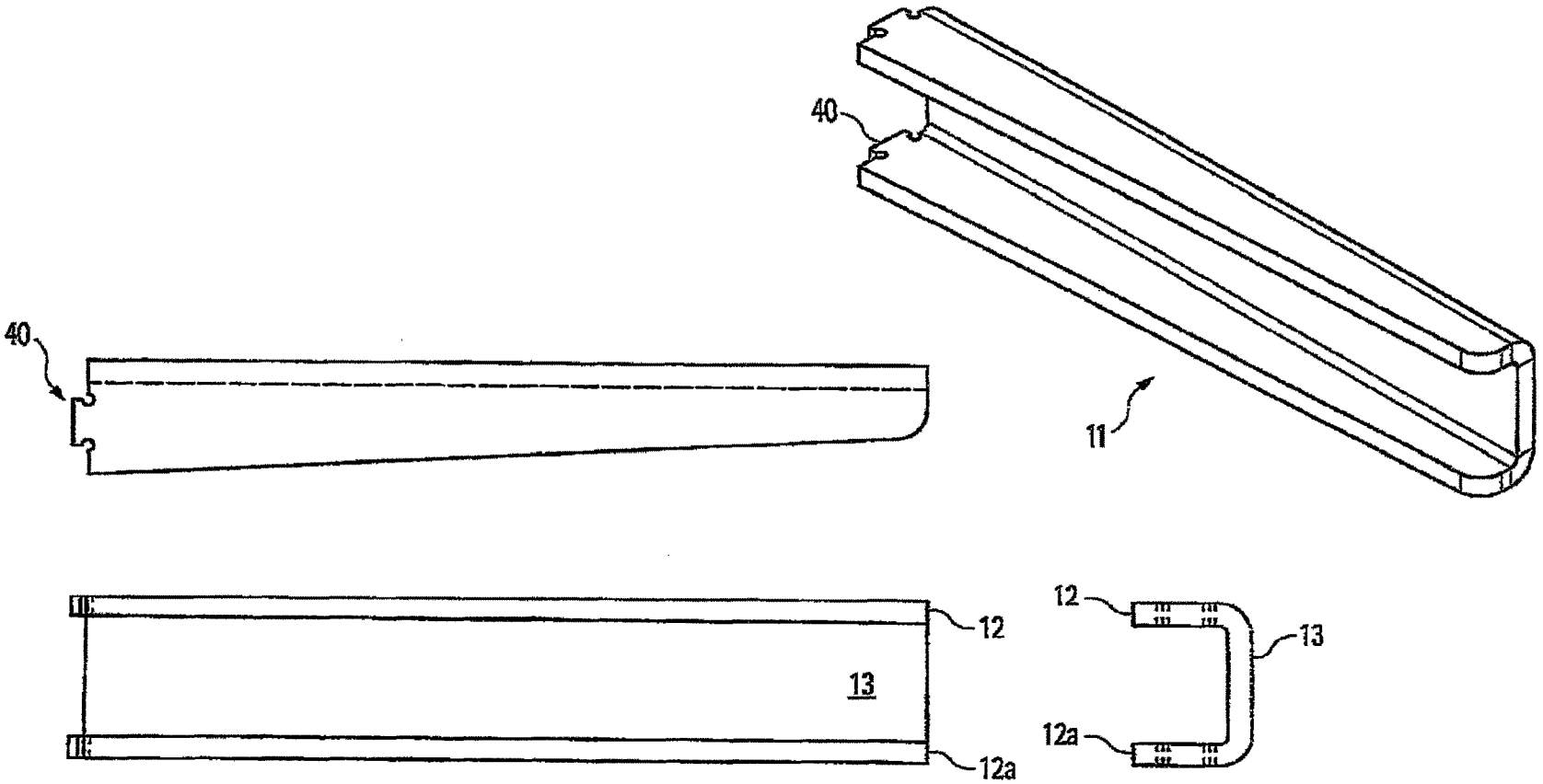
Figure 12:
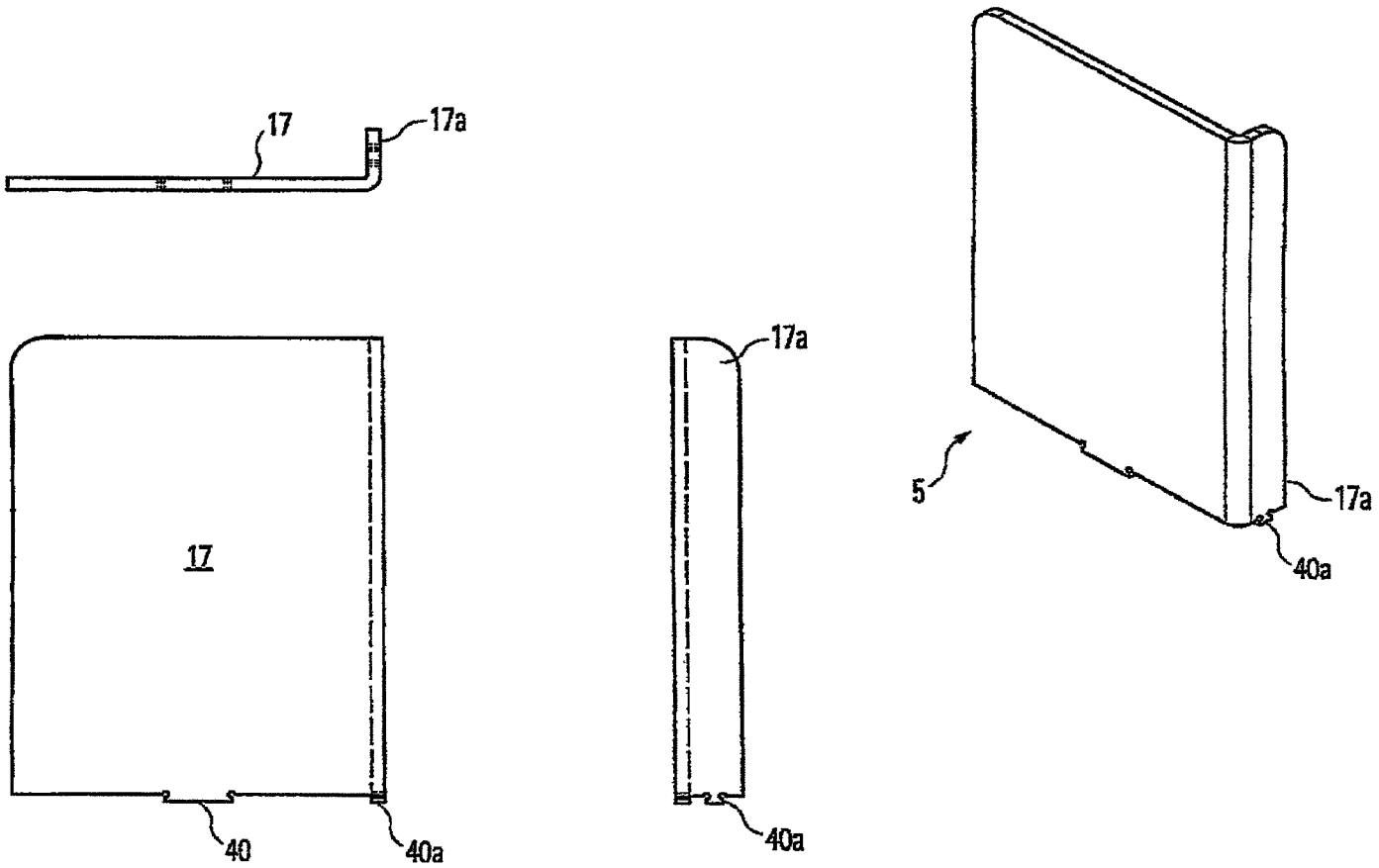
Figure 13:
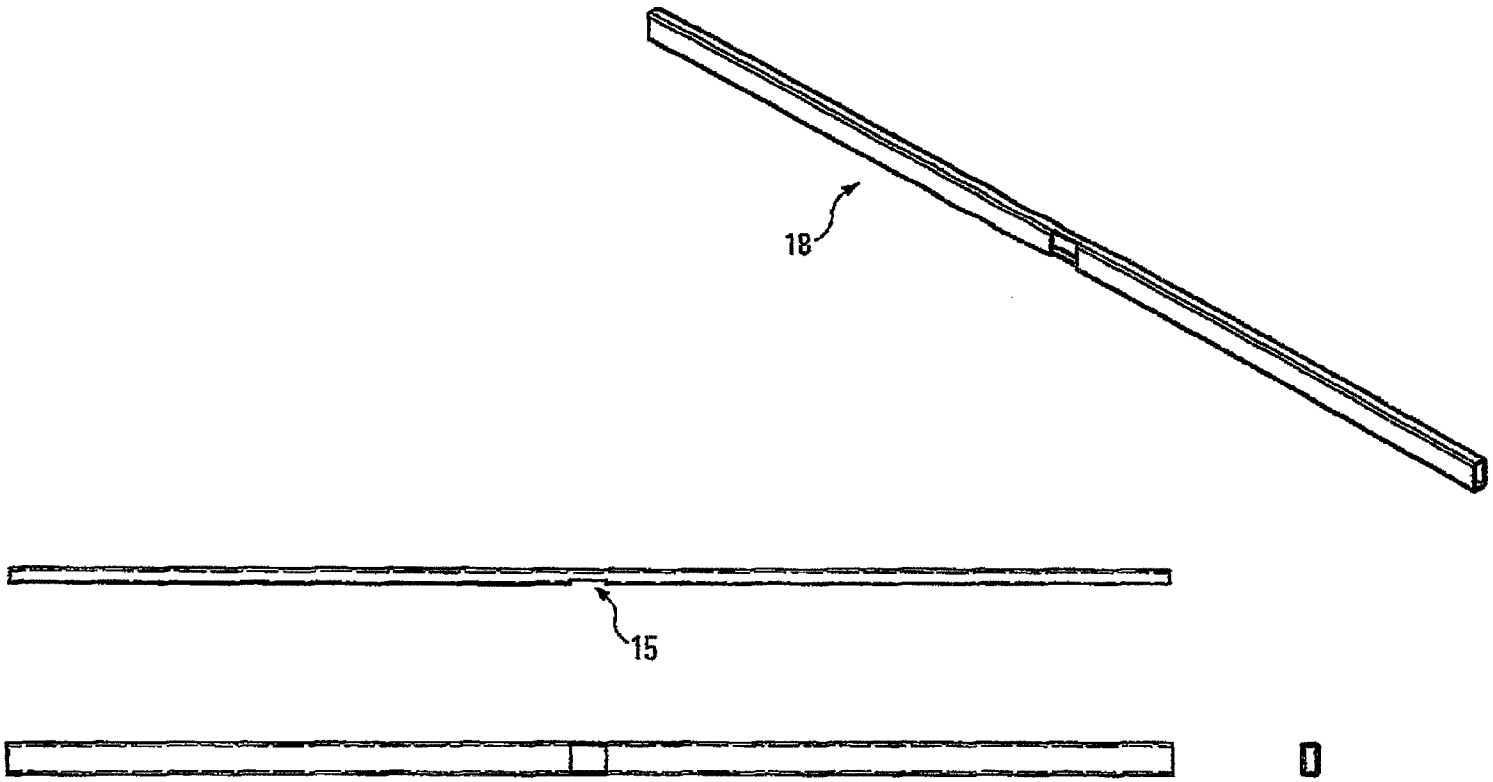
Figure 14:
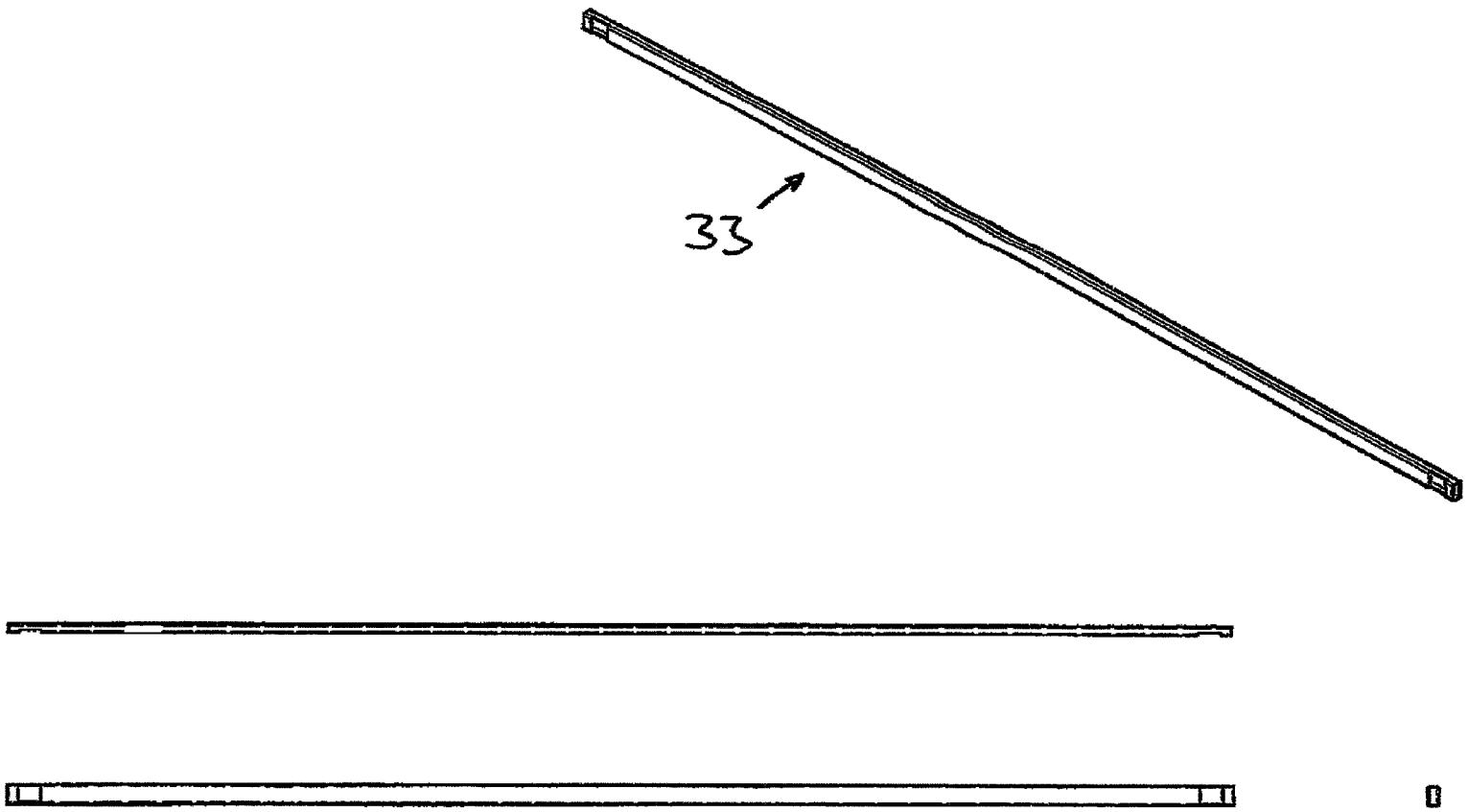
Figure 15:
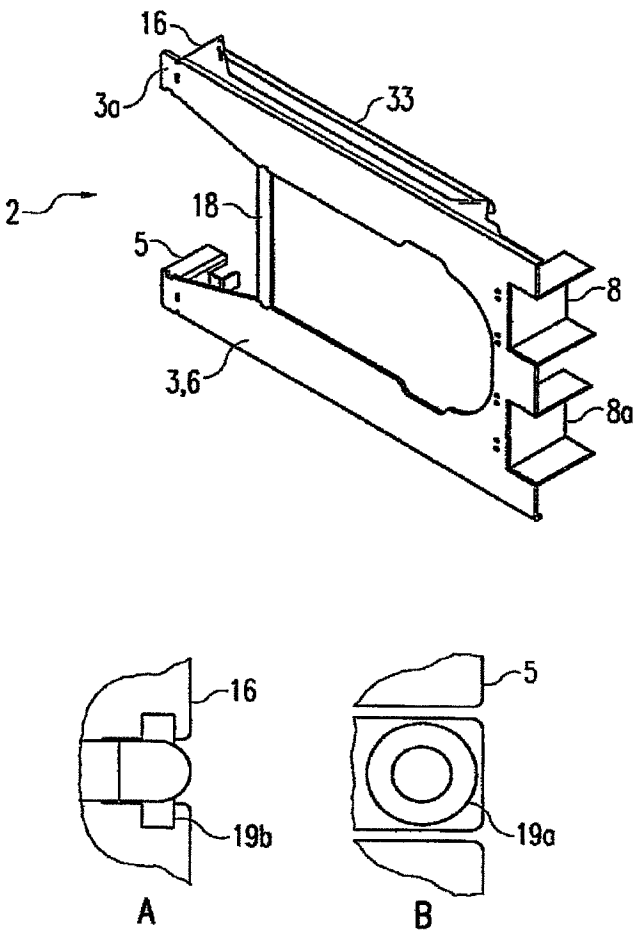
Figure 15:
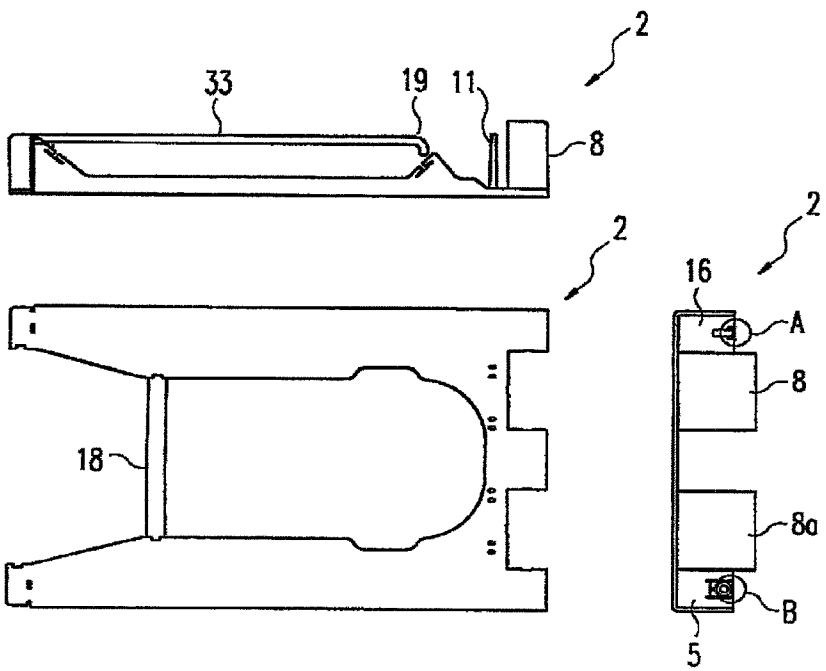
Figure 16:
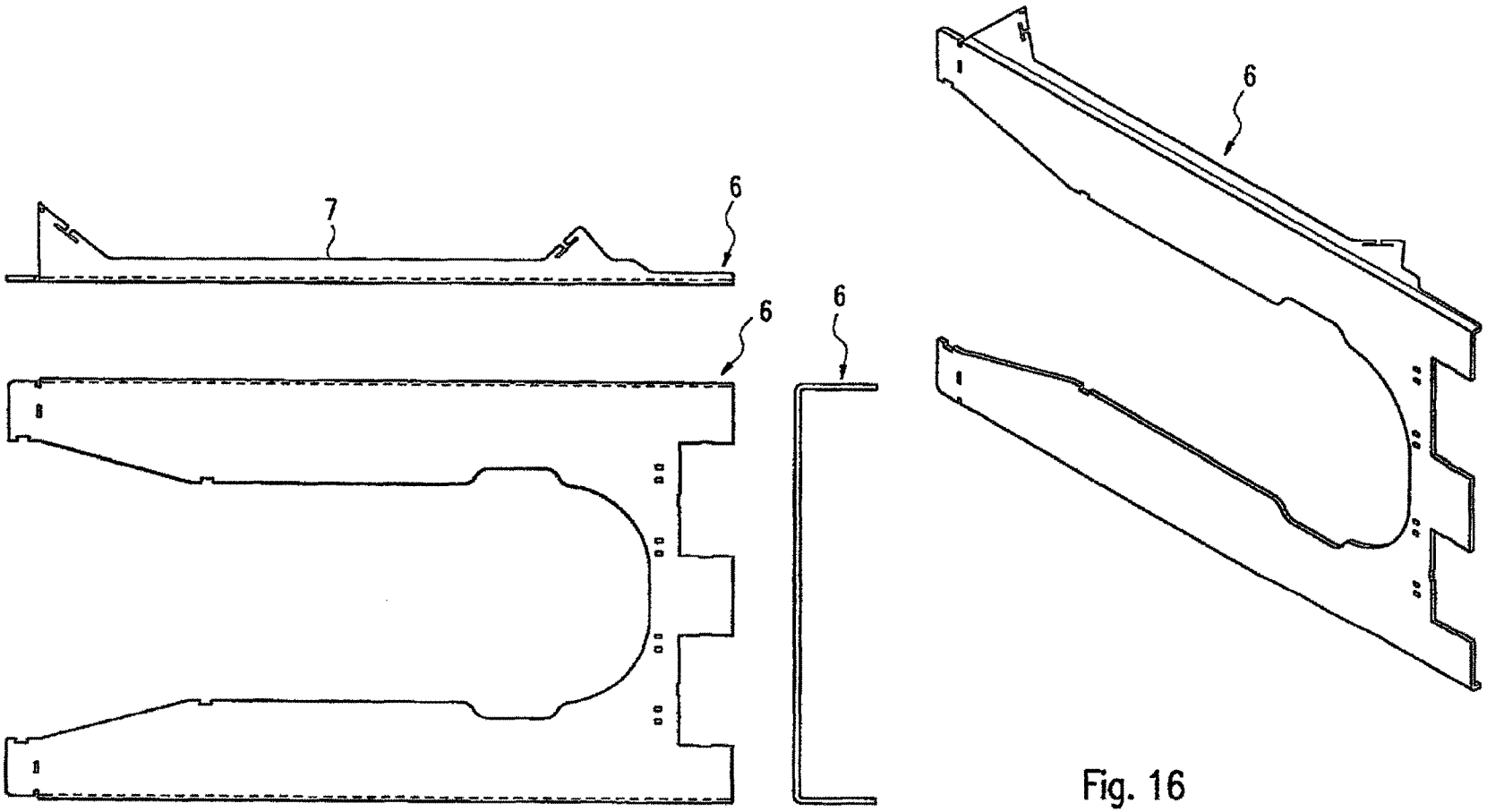
Figure 17:
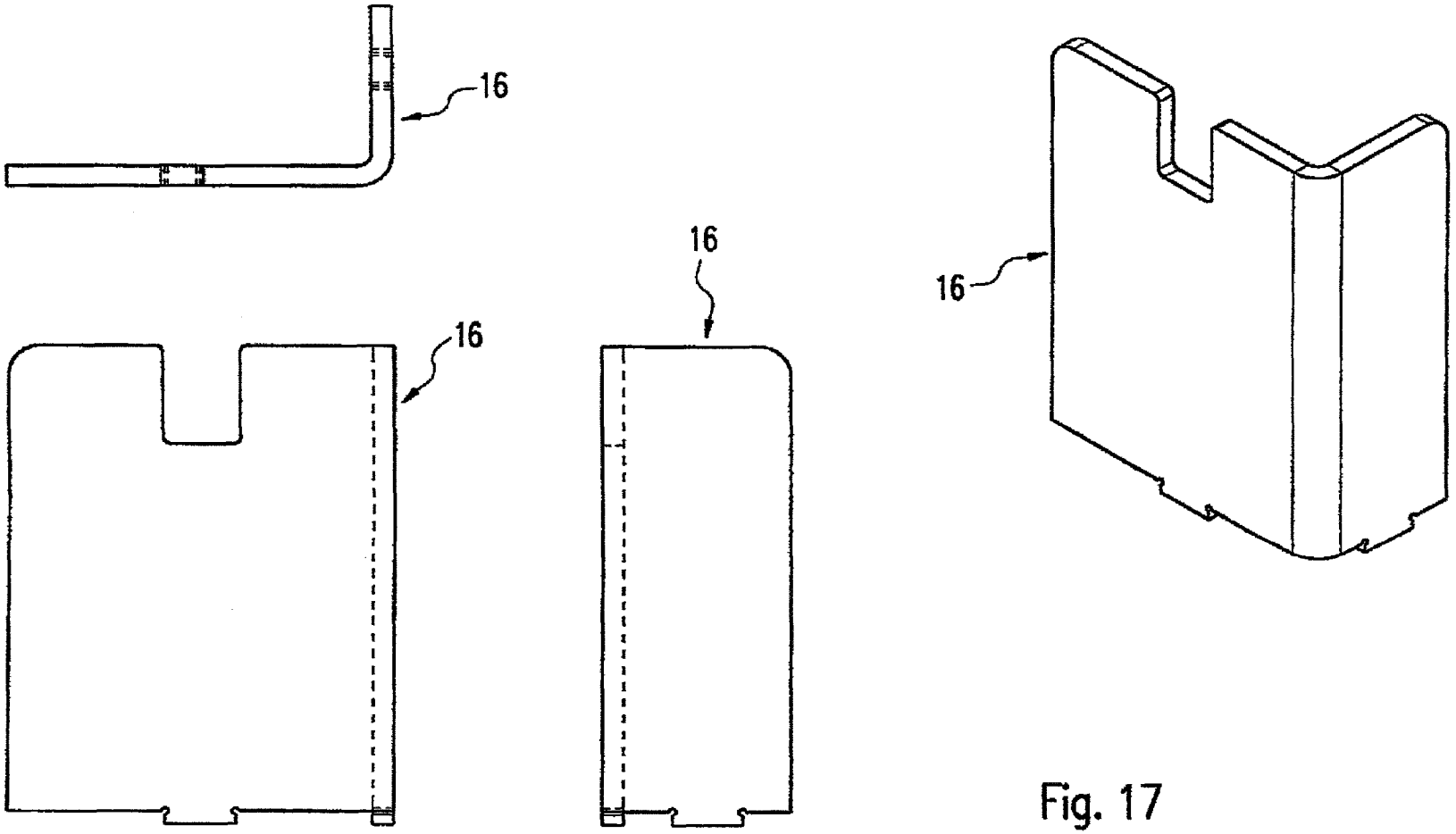
Figure 18:
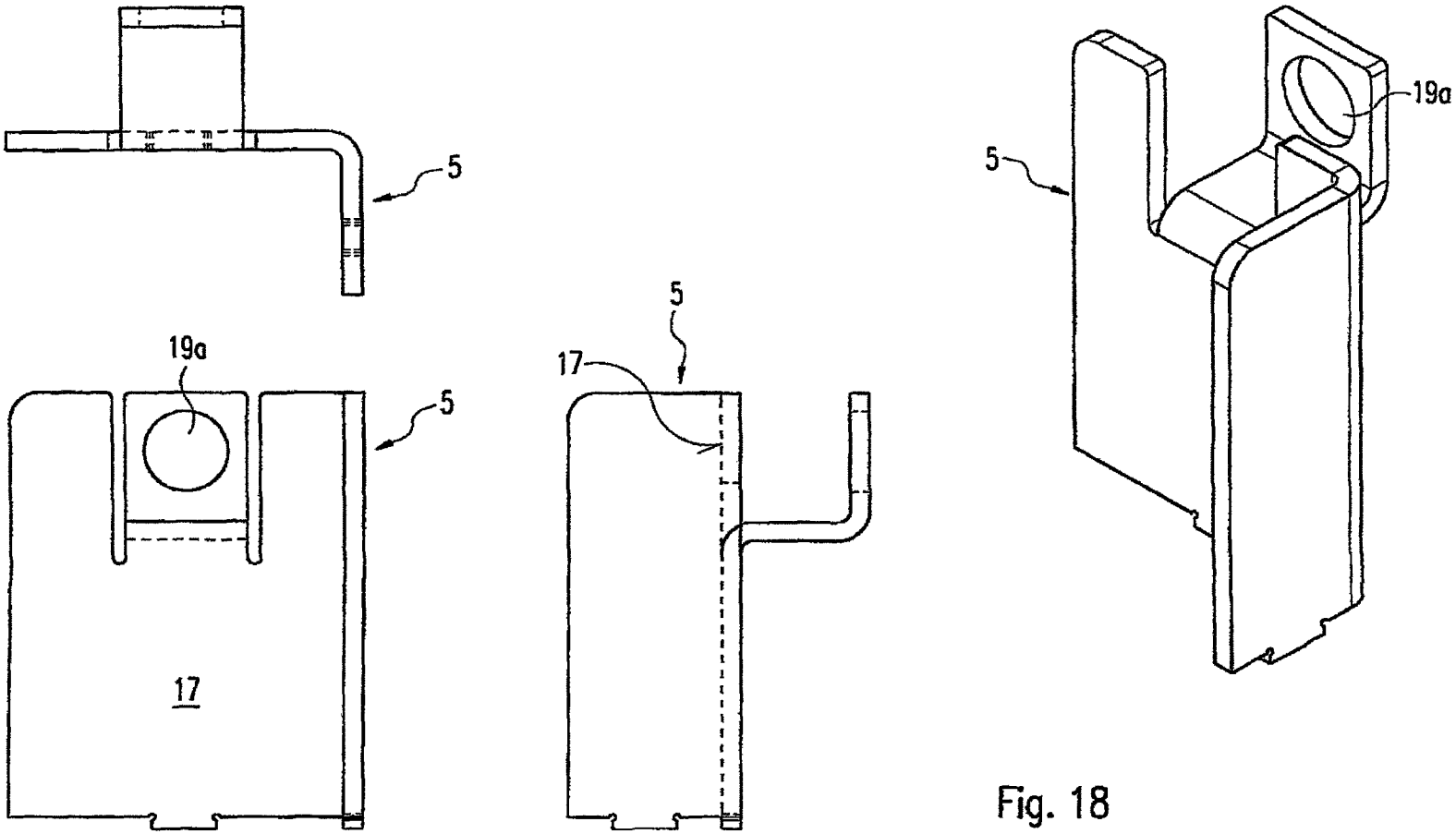
Figure 19:
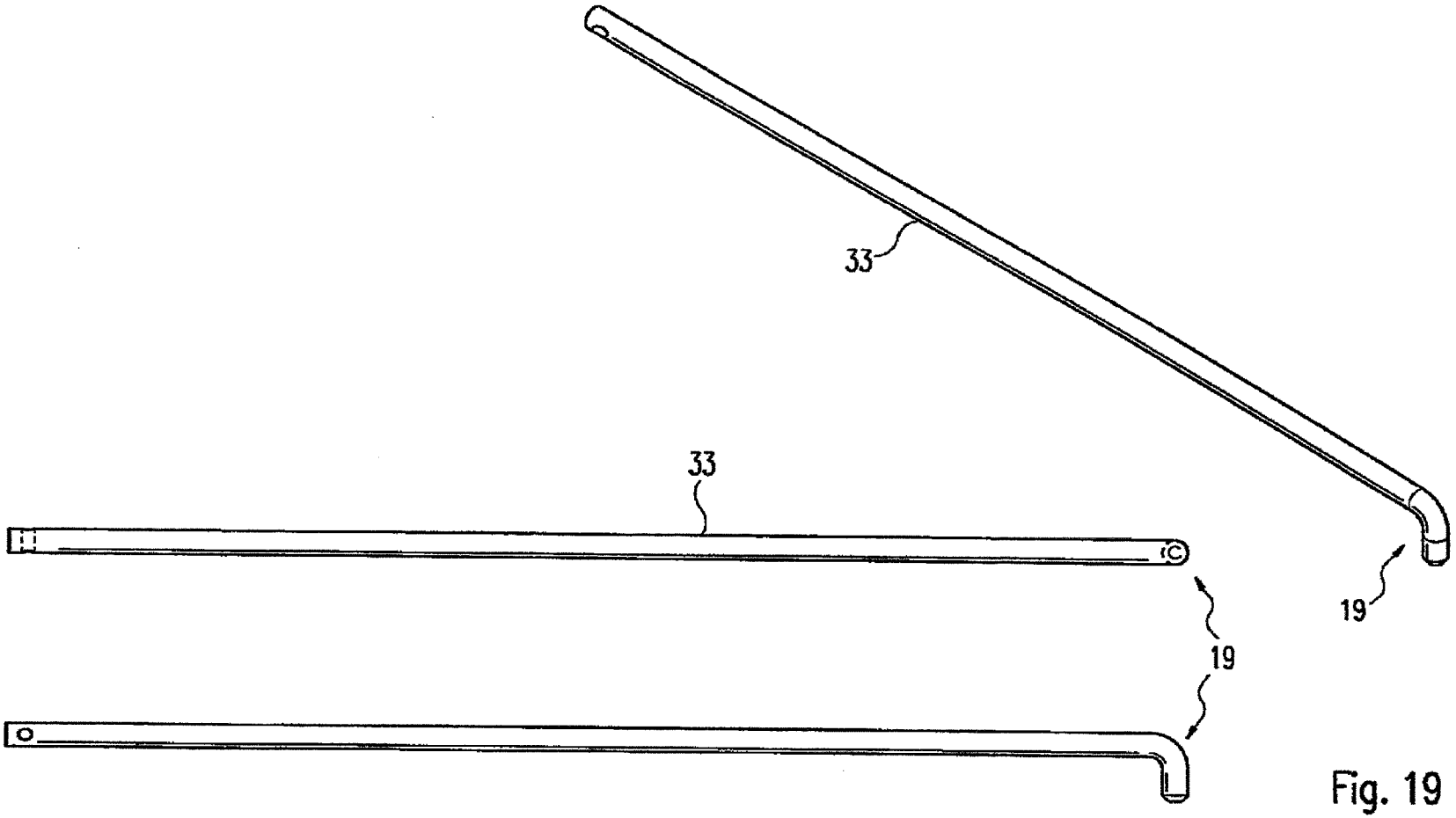
Figure 20:
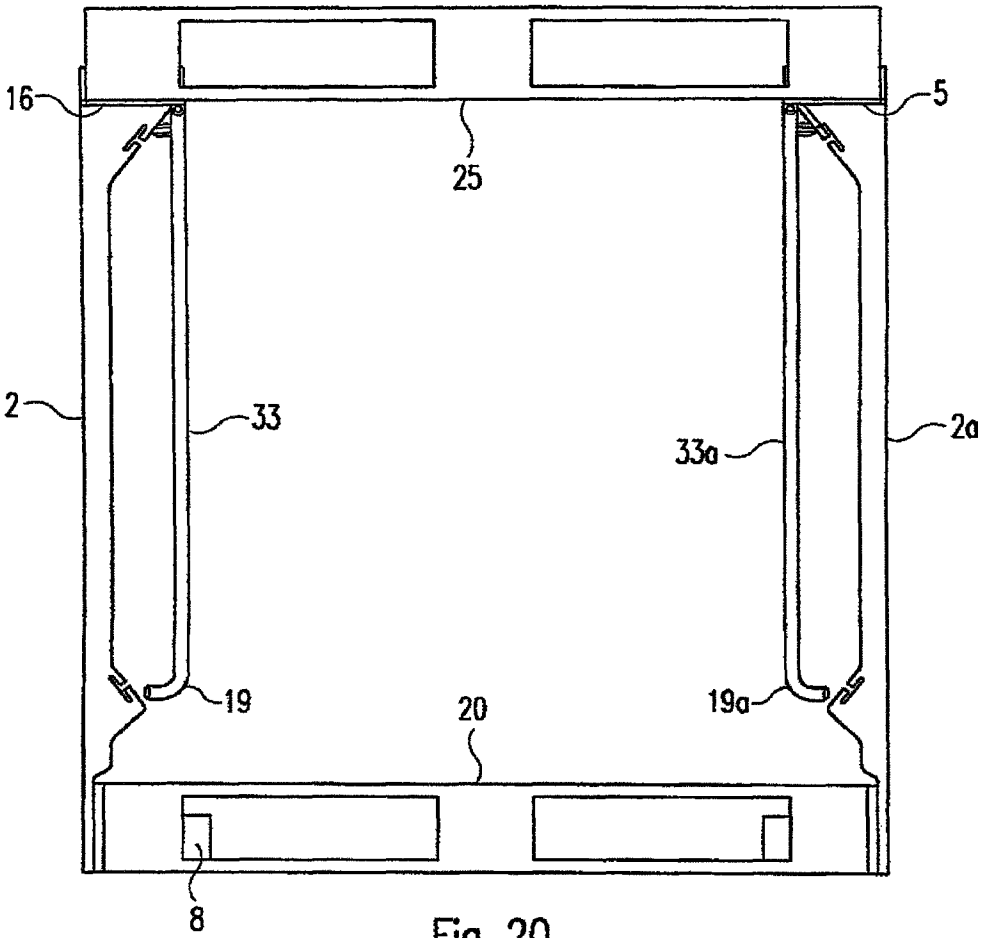
Figure 21:
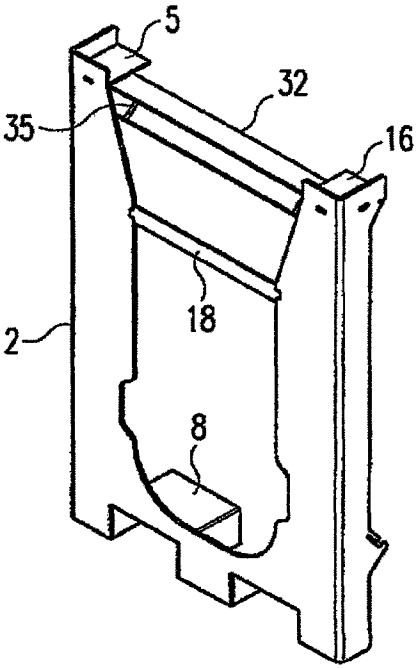
Figure 21:
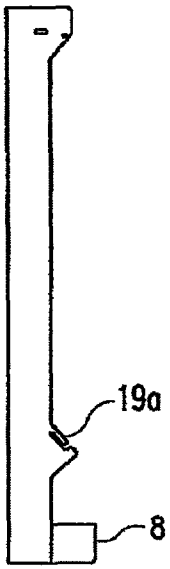
Figure 21:
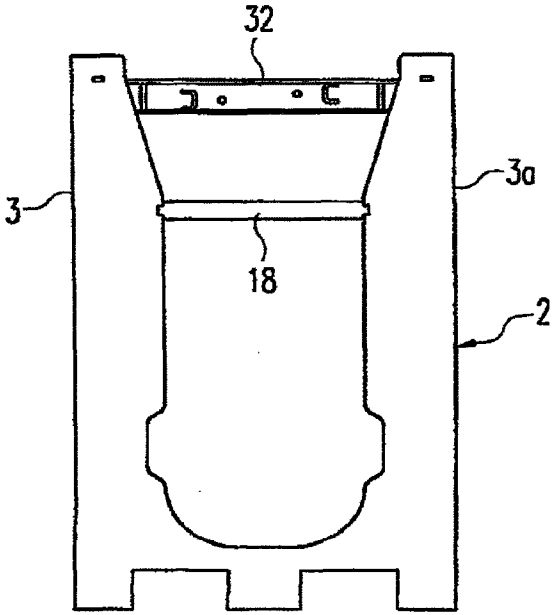
Figure 21:
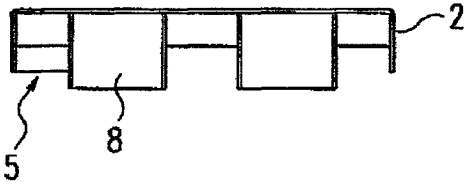
Figure 22:
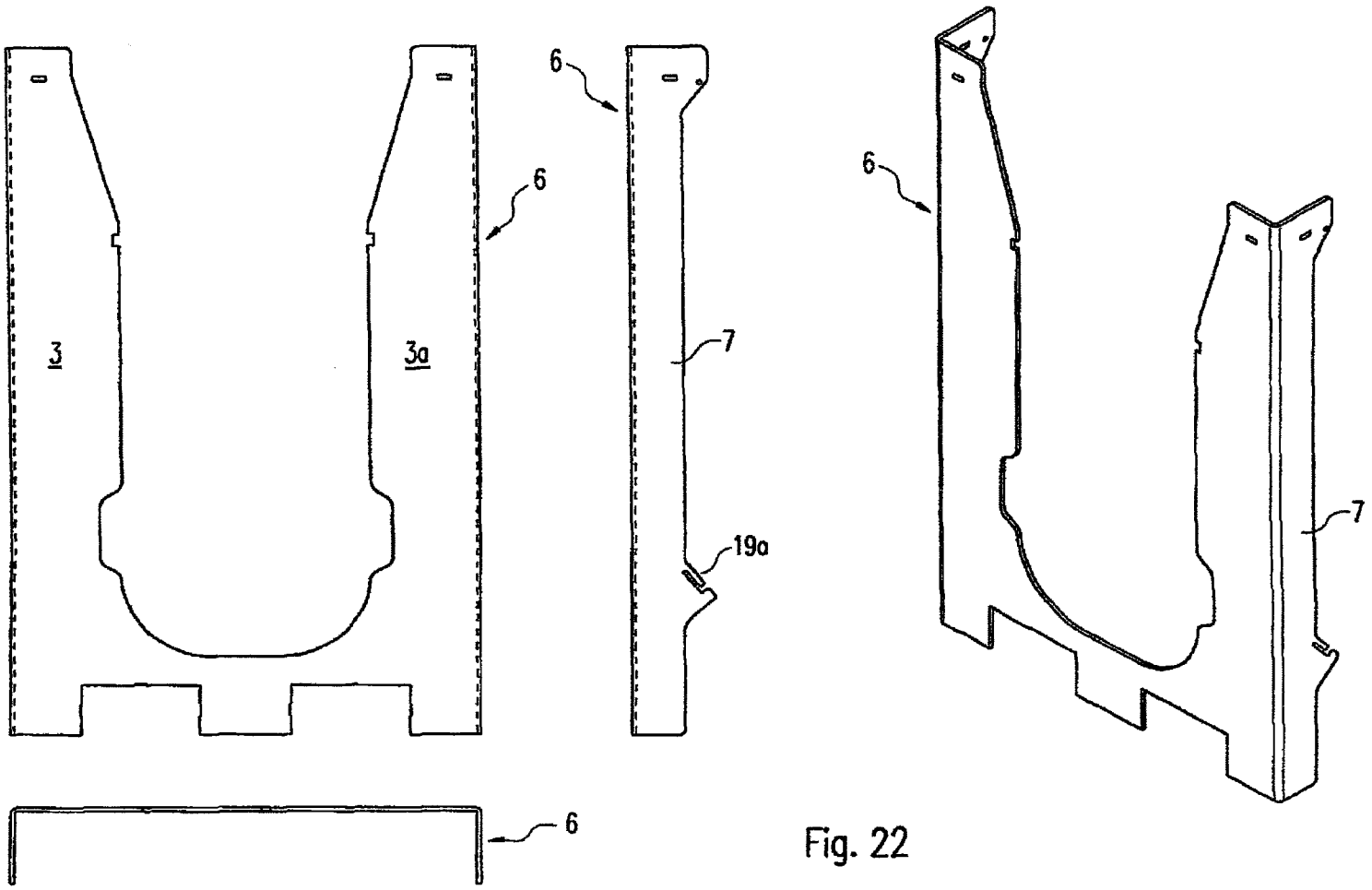
Figure 23:
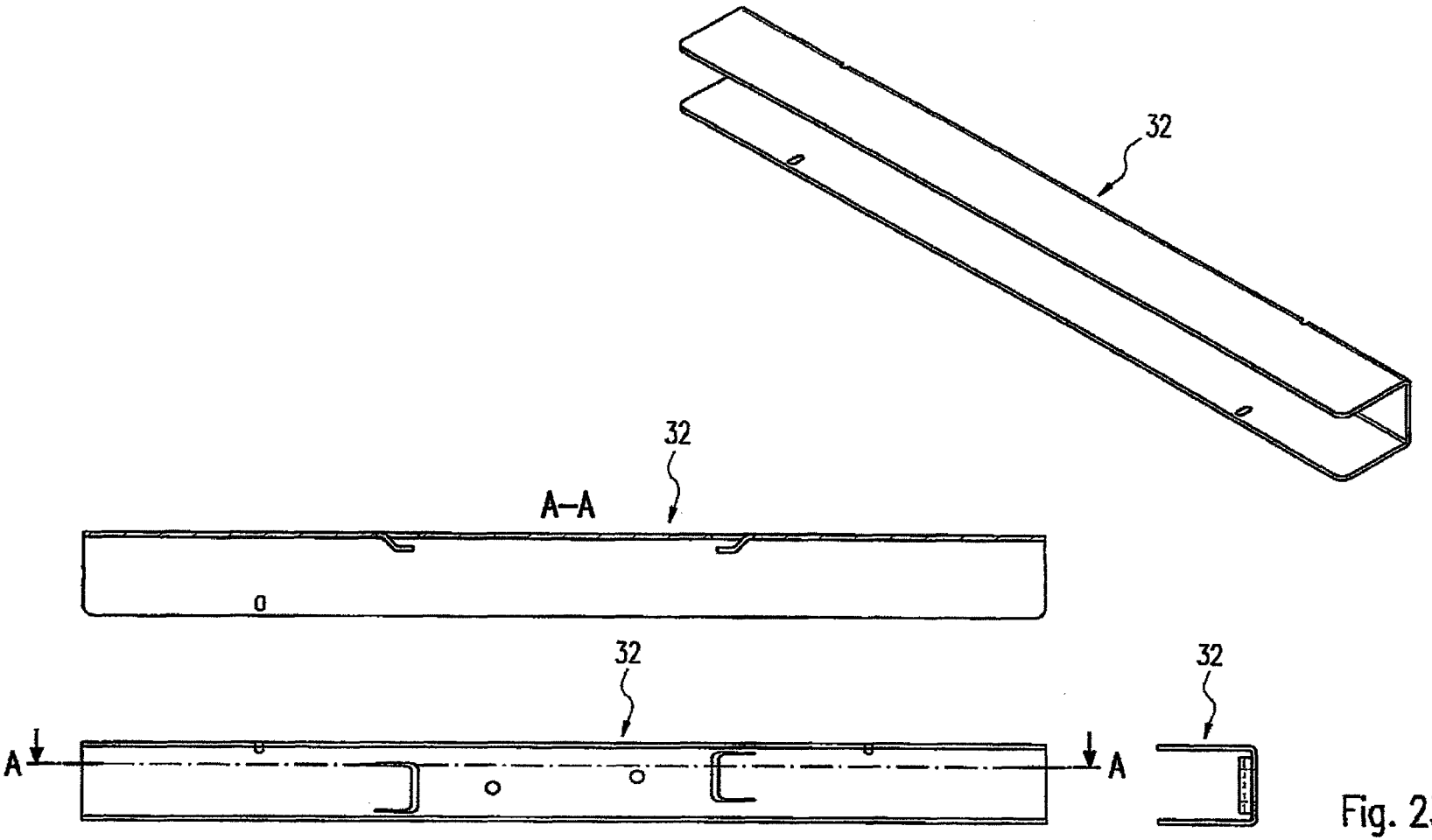
Figure 24:
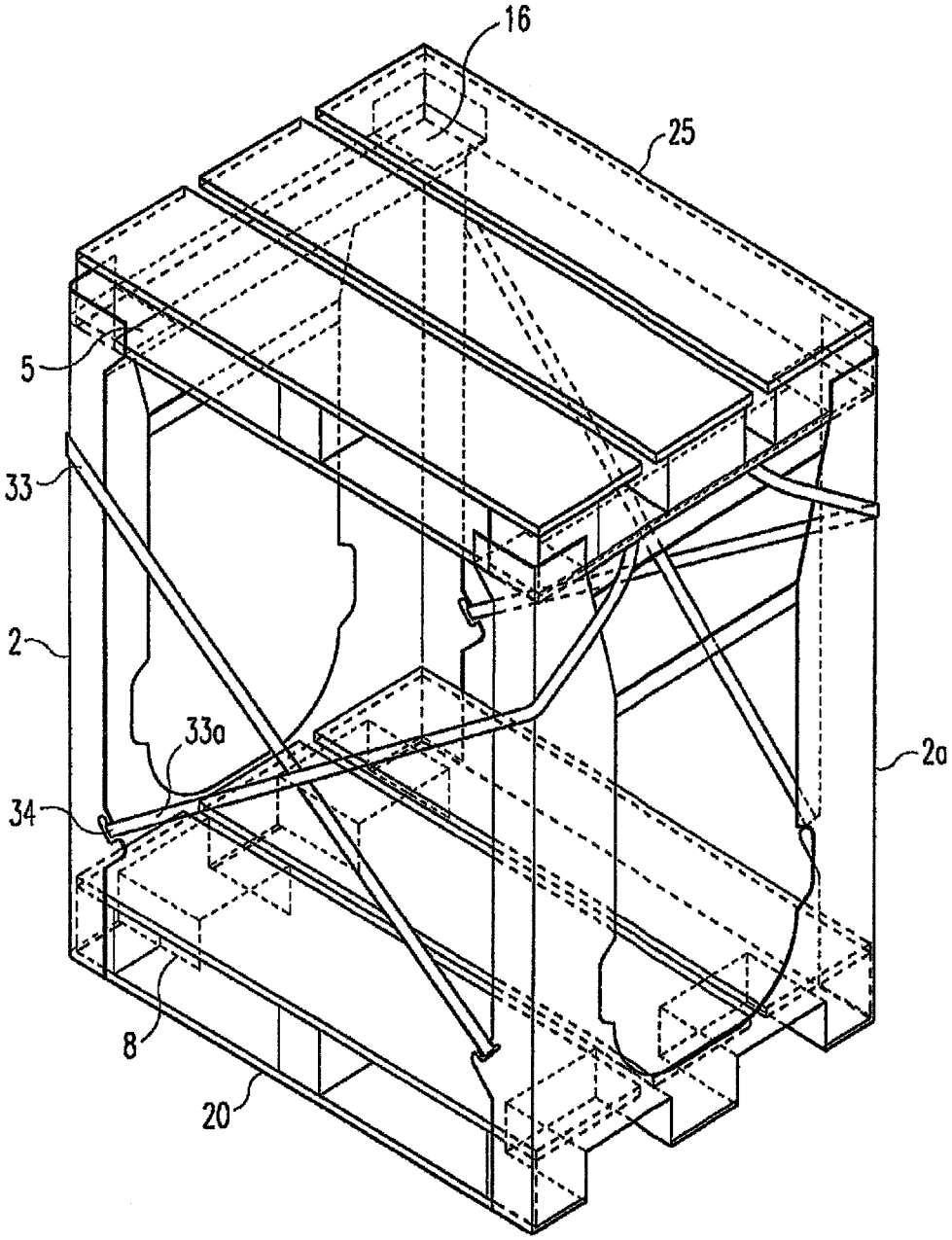

Further advantages, features and possible uses of the present invention will emerge from the following description in conjunction with the figures, in which:

FIG. 1 partially schematically shows an arrangement with a preferred refinement of the transport aid device and with two pallets, FIG. 2 partially schematically shows a perspective view of a support device of a preferred refinement of the transport aid device, FIG. 3 partially schematically shows a detail of the arrangement of FIG. 1, FIG. 4 partially schematically shows a further arrangement with a preferred refinement of the transport aid device and with a pallet, FIG. 5 partially schematically shows various views of a preferred refinement of the transport aid device, FIG. 6 partially schematically shows various views of a preferred refinement of the transport aid device, FIG. 7 partially schematically shows various views of a preferred refinement of the transport aid device, FIG. 8 partially schematically shows various views of a preferred refinement of the transport aid device, FIG. 9 partially schematically shows various views of a bottom plate of a preferred refinement of the transport aid device, FIG. 10 partially schematically shows various views of a first connecting projection of a preferred refinement of the transport aid device, FIG. 11 partially schematically shows various views of a second connecting projection of a preferred refinement of the transport aid device, FIG. 12 partially schematically shows various views of a holding element of a preferred refinement of the transport aid device, FIG. 13 partially schematically shows various views of a stabilizing strut of a preferred refinement of the transport aid device, FIG. 14 partially schematically shows various views of a connecting strut of a preferred refinement of the transport aid device, FIG. 15 partially schematically shows one of the support devices of a preferred refinement of the transport aid device, FIG. 16 partially schematically shows a bottom plate of the support device of FIG. 15, FIG. 17 partially schematically shows a holding element of the support device of FIG. 15, FIG. 18 partially schematically shows a further holding element of the support device of FIG. 15, FIG. 19 partially schematically shows a connecting strut of the preferred refinement of the transport aid device of FIG. 15, FIG. 20 partially schematically shows the transport aid device of FIG. 15 with two pallets, FIG. 21 partially schematically shows one of the support devices of a further preferred refinement of the transport aid device, FIG. 22 partially schematically shows a bottom plate of the support device of FIG. 21, FIG. 23 partially schematically shows a functional strut of the support device of FIG. 21, FIG. 24 partially schematically shows the transport aid device of FIG. 21 with two pallets.

FIG. 1 partially schematically shows an arrangement with a preferred refinement of the transport aid device 1 and with two pallets 20, 25.

Two support devices 2, 2*a* are connected to the first, lower pallet 20 and bear against the opposite shell surface 24, 24*a*. The two support devices 2, 2*a* are connected to one another by way of two connecting struts 33, 33*a*. The connecting struts 33, 33*a* stabilize the transport aid device and counteract an undesired relative movement of the two support devices 2, 2*a*.

The second pallet 25 is set down on holding elements 5, of the support devices 2, 2*a*. By way of the transport aid device, the first pallet 20 can be loaded with pressure-sensitive pallet goods, and/or only partially loaded, without the need for the space between the second pallet 25 arranged thereabove and an upper delimitation of the loading space, for example the roof of a heavy goods vehicle body, to remain unutilized.

The following statements relate to the left-hand support device 2, wherein the right-hand support device 2*a* is of substantially identical form.

The connecting element 4 of the support device 2 has two first connecting projections 8 and multiple second connecting projections 11, 11*a*, 11*b*, 11*c* which extend in each case substantially perpendicularly from the bottom plate 6. The first connecting projections 8 with substantially U-shaped cross sections engage into lifting means recesses 22 of the first pallet 20. The first connecting projections 8 have in each case second limbs 13 which extend below the loading base of the first pallet within in each case one lifting means recess 22 and which can bear against the loading base 21. The first connecting projections 8 have in each case two stiffening limbs 9 which, in particular during transport, can be supported on a loading space base or on a floor of a storage site. Furthermore, the stiffening limbs 9 stiffen the second limb 13 and thus the first connecting projection 8. The second connecting projections 11 extend in each case within a gap of the loading base 21, in particular between in each case two of the loading base boards of the first pallet 20.

Stiffening ribs 7, 7*a* for the stiffening of the bottom plate 6, of one of the support beams 3 and/or of the support device 2 extend, in sections, from the bottom plate 6. The first stiffening ribs 7, 7*a* extend in each case in sections along delimiting edges, which during transport are oriented substantially vertically, of the bottom plate 6 and/or of the support device 2. The bottom plate 6 is in each case cut out of a metal plate.

The support beams 3, 3*a*, which are arranged substantially parallel to one another, are connected, and supported relative to one another, by way of a stabilizing strut 18. Furthermore, the stiffening ribs 7, 7*a* also act so as to stiffen the support beams 3, 3*a*. Holding elements 5 are connected to a first end, which is the upper end during transport, of the support beams 3, 3*a*.

The holding elements 5 have in each case one first, substantially horizontally oriented first support surface 17 and at least one second support projection 17*a*, which is angled relative to the first support surface 17. The first support surfaces 17 serve for the support of the second pallet 25 and for spacing the second pallet 25 apart from the first pallet 20. The support projections 17*a* counteract an undesired displacement of the second pallet 25 relative to the first support surface 17. It is preferable for at least one of the support projections 17*a* to enclose an angle of between 90° and 135° with the first support surface 17 of the same holding element 5. The setting-down of the second pallet 25 onto the holding elements 5 is advantageously simplified by way of the support projections 17*a*.

The stiffening ribs 7, 7*a* have in each case mechanical connecting means 19, 19*a* for detachable connection to one of the connecting struts 33 formed with a belt. One of the mechanical connecting means is formed with a pin 19, which is in particular cut out of the stiffening rib 7*a* and which extends, during transport, substantially in a vertical direction and which is in particular connectable to a lashing means, in the form of a loop 34, of the connecting strut 33*a*. During the dismantling of the transport aid device, said loop 34 must preferably be released.

Another mechanical connecting means is formed with two projections 19*a*, 19*b*, which are in particular cut out of the stiffening rib 7*a* and which, during transport, extend substantially in a vertical direction. During transport, one of said projections 19*a* points downward, the other of said projections 19*b* points upward, and a gap remains between the free ends of said projections 19*a*, 19*b*. A lashing means, in the form of a loop 34, of the connecting strut 33 formed with a belt can be led through said gap and placed over both projections 19*a*, 19*b*.

FIG. 2 partially schematically shows a perspective view of a support device 2 of a preferred refinement of the transport aid device 1.

Stiffening ribs 7, 7*a* extend at least in sections from opposite delimiting edges of the metallic bottom plate of the support device 2. The free ends, and the holding elements arranged there, of the substantially vertically oriented support beams 3, 3*a* are not illustrated.

The connecting element 4 is formed with two first connecting projections 8, 8*a* and with four second connecting projections 11, 11*a*, 11*b*, 11*c*. The connecting projections 8, 11 have in each case U-shaped cross sections. The first connecting projections 8, 8*a*, which are to be inserted into lifting means recesses 22, have in each case one second limb 10, 10*a* which is in particular oriented substantially horizontally during transport and on which the loading base 21 of the first pallet can lie during transport. The first connecting projections 8, 8*a* have stiffening limbs 9, 9*a*, 9*b*, 9*c*, which can stiffen the second limbs 10, 10*a* and which, in particular during transport, can be supported on a loading space base or on the floor of a storage site. The spacing between the first connecting projections 8 and the second connecting projections 11 is dimensioned such that the loading base (not illustrated) of a pallet can be received only with little play between the connecting projections 8, 11. The connecting projections 8, 11 are welded to the bottom plate 6. The statements relating to the preceding figures apply otherwise.

The mechanical connecting means 19 is formed with a pin 19 which is in particular cut out of the stiffening rib 7 and which, during transport, extends substantially in a vertical direction and which is in particular connectable to a lashing means, in the form of a loop 34, of the connecting strut 33*a*. During the dismantling of the transport aid device, said loop 34 must preferably be released. The statements relating to the preceding figures apply otherwise.

The mechanical connecting means is formed with two projections 19*a*, 19*b*, which are in particular cut out of the stiffening rib 7 and which during transport extend substantially in a vertical direction. During transport, one of said projections 19*a* points downward, the other of said projections 19*b* points upward, and a gap remains between the free ends of said projections 19*a*, 19*b*. A lashing means, in the form of a loop 34, of the connecting strut 33 can be led through said gap and placed over both projections 19*a*, 19*b*. Owing to the loop 34, the projections 19*a*, 19*b* and the gap between said projections 19*a*, 19*b* are not visible. The statements relating to the preceding figures apply otherwise.

FIG. 3 partially schematically shows a detail of the arrangement of FIG. 1.

The second pallet 25 has also been set down on the holding element 5. The holding element 5 is connected to the first end of the support beam 3. From the support beam 3, the stabilizing strut 18 extends to the adjacent support beam (not illustrated).

A support projection 17*a* extend from delimiting edges, which are arranged substantially at right angles to one another, of the first support surface 17. The support projection 17*a* counteracts an undesired displacement of the second pallet 25 relative to the first support surface 17. The statements relating to the preceding figures apply otherwise.

FIG. 4 partially schematically shows a further arrangement with a preferred refinement of the transport aid device and with a pallet. The transport aid device of FIG. 1 has been set down on the loading base 21 of the pallet 20 for the purposes of storage or return transport. The first support device 2 has been set down on the pallet 20, and the second support device 2*a* has been set down on the first support device 2. The two support devices 2, 2*a* are detachably mechanically connected to the pallet 20, preferably by way of at least one of the connecting struts 33 formed with a belt. The two support devices 2, 2*a* extend only to an insignificant extent beyond delimiting edges of the loading base 21. In this state, the transport aid device 1 can be stored, and/or transported between two storage sites, with little effort. The statements relating to the preceding figures apply otherwise.

FIG. 5 partially schematically shows various views of a preferred refinement of the transport aid device.

Stiffening ribs 7, 7*a* extend at least in sections from opposite delimiting edges of the metallic bottom plate of the support device 2 for the purposes of stiffening the bottom plate 6 and the support device 2. The stiffening ribs 7, 7*a* have mechanical connecting means 19 correspondingly to FIG. 2. The connecting element 4 is formed with first connecting projections 8 and with second connecting projections 11 correspondingly, to FIG. 2. First ends of the support beams 3, 3*a*, which are oriented substantially parallel, have holding elements 5, 5*a* substantially corresponding to those of FIG. 1. A stabilizing strut 18 connects the support beams 3, 3*a* and a further stabilizing strut 18*a* connects the holding elements 5, 5*a*, in particular for the purposes of mechanically stabilizing the support device 2. The connecting strut 33 formed with a tensile bar serves for detachable mechanical connection to the stabilizing struts 18*a*. The statements relating to the preceding figures apply otherwise.

FIG. 6 partially schematically shows various views of a preferred refinement of the transport aid device. Below, the differences in relation to the embodiment of FIG. 5 will be discussed. The stiffening rib 7 extends over the entire length of the support beam 3*a* and forms a limb of the support beam 3*a*. The stiffening rib 7 has a mechanical connecting means 19 correspondingly to FIG. 2. The support beam 3*a* has multiple recesses 15, 15*a* for detachable mechanical connection to one of the connecting struts. The connecting strut 33 formed with a tensile bar serves for detachable mechanical connection to the stabilizing struts 18*a*.

FIG. 7 partially schematically shows various views of a preferred refinement of the transport aid device.

Stiffening ribs 7, 7*a* extend at least in sections from opposite delimiting edges of the metallic bottom plate of the support device 2 for the purposes of stiffening the bottom plate 6 and the support device 2. The stiffening ribs 7, 7*a* have mechanical connecting means 19 correspondingly to FIG. 2. The connecting element 4 is formed with first connecting projections 8 and with second connecting projections 11 correspondingly to FIG. 2. First ends of the support beams 3, 3*a*, which are oriented substantially parallel, have holding elements 5, 5*a* substantially corresponding to those of FIG. 1. A stabilizing strut 18 connects the support beams 3, 3*a* and a further stabilizing strut 18*a* connects the holding elements 5, 5*a*, in particular for the purposes of mechanically stabilizing the support device 2. The connecting strut 33 formed with a tensile bar serves for detachable mechanical connection to the stabilizing struts 18*a*. The statements relating to the preceding figures apply otherwise.

FIG. 8 partially schematically shows various views of a preferred refinement of the transport aid device. Below, the differences in relation to the embodiment of FIG. 6 will be discussed. The support device 2, or the support beam 3*a* thereof, has a foot plate 14 which, during transport, can support the first pallet (not illustrated). The foot plate 14 is preferably connected, particularly preferably in integrally bonded fashion, to the stiffening limb 9, in particular for improved mechanical stability of the connecting element 4. The connecting strut 33 formed with a tensile bar serves for detachable mechanical connection to the stabilizing struts 18*a*.

FIG. 9 partially schematically shows various views of a bottom plate 6 of a preferred refinement of the transport aid device.

Stiffening ribs 7, 7*a* extend in sections from the bottom plate 6. Holding elements 5, 5*a* are connected to the first ends of the support beams 3, 3*a*. The connecting element has not yet been fully produced. The bottom plate 6 has multiple recesses 15 for later connection to first and/or second connecting projections of the connecting element.

The stiffening ribs 7, 7*a* have in each case mechanical connecting means 19, 19*a* for detachable connection to one of the connecting struts 33. One of the mechanical connecting means is formed with a pin 19, which is in particular cut out of the stiffening rib 7*a* and which extends, during transport, substantially in a vertical direction and which is in particular connectable to a lashing means, in the form of a loop 34, of the connecting strut 33*a*. During the dismantling of the transport aid device, said loop 34 must preferably be released.

Another mechanical connecting means is formed with two projections 19*a*, 19*b*, which are in particular cut out of the stiffening rib 7*a* and which, during transport, extend substantially in a vertical direction. During transport, one of said projections 19*a* points downward, the other of said projections 19*b* points upward, and a gap remains between the free ends of said projections 19*a*, 19*b*. A lashing means, in the form of a loop 34, of the connecting strut 33 can be led through said gap and placed over both projections 19*a*, 19*b*.

FIG. 10 partially schematically shows various views of a first connecting projection 8 of a preferred refinement of the transport aid device. The first connecting projection 8 is provided for later connection, in integrally bonded fashion, to the bottom plate.

The first connecting projection 8 has a second limb 10 which is supported by two stiffening limbs 9, 9*a*. The first connecting projection 8 is produced with a metal plate. The stiffening limbs 9, 9*a* are produced by folding of the metal plate.

Connecting sections 40, 40*a*, 40*b* extend from the limbs 9, 10. Said connecting sections are provided for mechanical connection to recesses 15 of the bottom plate 6 of FIG. 9.

FIG. 11 partially schematically shows various views of a second connecting projection 11 of a preferred refinement of the transport aid device. The second connecting projection 11 is provided for later connection, in integrally bonded fashion, to the bottom plate 6 for example of FIG. 9.

The second connecting projection 11 has a second limb 13 which is supported by two stiffening limbs 12, 12*a*. The second connecting projection 11 is produced with a metal plate. The stiffening limbs 12, 12*a* are produced by folding of the metal plate.

Connecting sections 40, 40*a* extend from the stiffening limbs 12, 12*a*. Said connecting sections are provided for mechanical connection to recesses 15 of the bottom plate 6 for example of FIG. 9.

FIG. 12 partially schematically shows various views of a holding element 5 of a preferred refinement of the transport aid device. The holding element 5 is provided for later connection, in integrally bonded fashion, to one of the support beams.

The holding element 5 is formed with a folded metal plate. The support projection 17*a* extends along a delimiting edge of the support surface 17. Connecting sections 40, 40*a* extend from the holding element 5, which connecting sections are provided for mechanical connection to recesses 15 of the bottom plate 6 for example of FIG. 9.

FIG. 13 partially schematically shows various views of a stabilizing strut 18 of a preferred refinement of the transport aid device.

The stabilizing strut 18 is formed with a metal profile and is provided for being connected at a later point in time, in particular in integrally bonded fashion, to the bottom plate 6 for example of FIG. 9 or to the two support beams of the same support device.

The stabilizing strut 18 has a recess 15 which is provided for detachable mechanical connection to a connecting strut of the same transport aid device.

FIG. 14 partially schematically shows various views of a connecting strut 33 of a preferred refinement of the transport aid device.

The connecting strut 33 is formed with a metal profile and is provided for being detachably mechanically connected at a later point in time to in each case one of the stabilizing struts of the two support devices. At its ends, the connecting strut 33 has in each case recesses which are provided for engaging into recesses of the stabilizing strut of FIG. 13.

FIG. 15 partially schematically shows various views of one of the support devices of a preferred refinement of the transport aid device.

The transport aid device has at least one of the connecting struts 33, wherein a first end of the connecting strut 33 is articulately connected to one of the holding elements 16 of the first support device 2 and has a shaft 19*b*. The holding element 16 has a receiving element for the shaft 19*b* of the connecting strut 33. A second end of the connecting strut 33, having a hook 19, is detachably mechanically connectable to a holding element of the second support device (not illustrated).

The first support device 2 also has a holding element 5 which serves for detachable mechanical connection to a connecting strut of the second support device (not illustrated). For this purpose, the holding element 5 has, in one section, a passage hole 19*a*, wherein the section is produced from the rest of the holding element 5 by deformation, whereby at least the thickness of the connecting strut of the second support device (not illustrated) can be compensated.

The connecting strut 33 can be reversibly transferred from a rest position, in which the connecting strut extends substantially along one of the support beams of the first support device 2, into a usage position, in which the mechanical connecting means is detachably connected to the first holding element of the second support device and the connecting strut extends substantially horizontally.

The support beams 3, 3*a* are connected to one another by way of a stabilizing strut 18. The holding element 5 and the holding element 16 are connected to different support beams 3, 3*a*. The bottom plate 6 is connected to first connecting projections 8, 8*a* and to second connecting projections 11.

FIG. 16 partially schematically shows a bottom plate of the support device of FIG. 15. Said bottom plate 3 has been produced by cutting and deformation and has been prepared for connection to holding elements and connecting projections. The bottom plate is preferably formed with aluminum. The stiffening rib is preferably produced by deformation.

FIG. 17 partially schematically shows a holding element 16 of the support device of FIG. 15, which differs from the holding element of FIG. 12 in particular by a recess for one of the connecting struts.

FIG. 18 partially schematically shows a further holding element 5 of the support device of FIG. 15, which differs from the holding element of FIG. 12 in particular by a section with the passage hole 19*a*. The plane of the passage hole 19*a* is spaced apart from the plane of the first support surface 17.

FIG. 19 partially schematically shows a connecting strut 33 of the preferred refinement of the transport aid device of FIG. 15. The first end of the connecting strut 33 has a passage hole for a shaft, and the second end has the hook 19.

FIG. 20 partially schematically shows the transport aid device of FIG. 15 with two pallets 20, 25. The first connecting strut 33 is articulately connected to the first support device 2 and the second connecting strut 33*a* is articulately connected to the second support device 2*a*. The connecting struts 33, 33*a* have not yet been transferred into their usage positions. The support devices 2, 2*a* have however already been connected, by way of their connecting elements or first connecting projections 8, to the lower pallet 20, and the second pallet 25 has been set down onto the holding elements 5, 16.

In the preferred refinement, the cohesion of the two support devices during transport or in the usage position can be improved.

FIG. 21 partially schematically shows one of the support devices 2 of a further preferred refinement of the transport aid device.

At least two of the support beams 3, 3*a* of the support device 2 are connected, in particular in integrally bonded fashion, to one another by way of the functional strut 32, wherein preferably, one, two or more of the connecting struts (not illustrated) are mechanically connectable to the functional strut 32. The functional strut is formed with a U-shaped profile which, in the usage position, are arranged below the holding elements 5, 16. Belt rollers or tension belts may be fastened within the U-shaped profile.

Furthermore, the support beams 3, 3*a* are connected to one another by way of one of the stabilizing struts 18. The support device 2 has two first connecting projections 8, 8*a* and has mechanical connecting means 19*a* for connecting struts (not illustrated).

FIG. 22 partially schematically shows a bottom plate 3 of the support device of FIG. 21 with stiffening ribs 7 and with mechanical connecting means 19*a* for connecting struts (not illustrated).

FIG. 23 partially schematically shows a functional strut 32 of the support device of FIG. 21, with a substantially U-shaped cross section. The functional strut 32 has been prepared for mechanical connection to two tension belts.

FIG. 24 partially schematically shows the transport aid device of FIG. 21 with two pallets 20, 25. The support devices 2, 2*a* have however already been connected, by way of their connecting elements or first connecting projections 8, to the lower pallet 20, and the second pallet 25 has been set down onto the holding elements 5, 16. The connecting struts 33, 33*a*, which are each in the form of a tension belt, have been transferred into their usage positions, that is to say the first ends of the connecting struts 33, 33*a* are detachably mechanically connected to the respective other support device 2, 2*a*. For this purpose, the first ends of the connecting struts 33, 33*a* have in each case a mechanical connecting means in the form of a loop 34. The tension belts have been tensioned and force the support devices 2, 2*a* toward one another.

In the preferred refinement, the cohesion of the two support devices during transport or in the usage position can be improved.

REFERENCE DESIGNATIONS

1 Transport aid device
2, 2*a* Support device
3, 3*a* Support beam of a support device
4 Connecting element of a support device
5, 16 Holding element of a support device
6 Bottom plate of a support device
7 Stiffening rib of the bottom plate
8 First connecting projection of the connecting element
9 Stiffening limb of the first connecting projection
10 Second limb of the first connecting projection
11 Second connecting projection of the connecting element
12 Stiffening limb of the second connecting projection
13 Second limb of the second connecting projection
14 Foot plate
15 Recess
17 First support surface of the holding element
17*a* Support projection of the holding element
18 Stabilizing strut
19 Mechanical connecting means
20, 25 Pallet, pallet body
21 Loading base of a pallet
22 First recess, lifting means recess of a pallet
23 Gap in the loading base
24 Shell surface of a pallet
32 Functional strut
33 Connecting strut
34 Lashing means of the connecting strut
35 Reinforcement for functional strut
40 Connecting section

The invention claimed is:

1. A transport aid device for at least two pallets, wherein the pallets each include a loading base which is oriented substantially horizontally in a usage position during transport, wherein the transport aid device includes a first support device and a second support device for supporting at least one of the pallets, both of the support devices comprising:

at least one connecting element for the mechanical connection of the support device to the first pallet, at least two support beams which, in the usage position during transport, extend substantially in a vertical direction and which each have a first end which, in the usage position during transport, forms the upper end of the respective support beam, at least two holding elements which are connected in each case to a first end of one of the two support beams, wherein each of the holding elements is provided for, in the usage position during transport of the two pallets, holding or supporting the second of said pallets with a vertical spacing to the first pallet, wherein at least one stiffening rib extends out of a bottom plate of one of the at least two support beams, wherein the at least one stiffening rib has a mechanical connecting means for mechanical connection to a connecting strut which includes at least one of a metal profile, a tensile bar, a cable, a chain, a strap and a belt.

2. The transport aid device as claimed in claim 1, wherein a first connecting projection of the at least one connecting element extends substantially at right angles to the bottom plate, and in the usage position substantially horizontally, out of the bottom plate of the support device, wherein the first connecting projection can engage mechanically into a first recess of one of the pallets.

3. The transport aid device as claimed in claim 2, further including a second connecting projection connected to the support device, wherein the second connecting projection in the usage position during transport has a vertical spacing to the first connecting projection, of the same connecting element, wherein a section of the first pallet can be mechanically received between the two connecting projections.

4. The transport aid device as claimed in claim 3, wherein at least one of the first and second connecting projections includes a limb, which can bear against a loading base of one of the pallets, and a stiffening limb, which is angled relative to the limb and which serves for stiffening the at least one of the first and second connecting projections.

5. The transport aid device as claimed in claim 1, wherein at least one of the at least two holding elements has a first support surface, which during transport is oriented substantially horizontally and which serves for supporting the second pallet, and at least one support projection, which is angled relative to the first support surface.

6. The transport aid device as claimed in claim 1, wherein the two support beams of at least one of the support devices are connected to one another by way of a first stabilizing strut.

7. The transport aid device as claimed in claim 1, having at least one connecting strut for the detachable mechanical connection of the first support device to the second support device.

8. The transport aid device as claimed in claim 7, wherein a first end of the connecting strut is articulately connected to one of the holding elements of the first support device, a second end, situated opposite the first end, of the connecting strut, having one of the mechanical connecting means, is detachably mechanically connectable to a first holding element of the second support device, the first holding element of the second support device has a mechanical connecting means which is complementary to the mechanical connecting means of the connecting strut.

9. The transport aid device as claimed in claim 1, wherein the two support beams of at least one of the support devices are connected to one another by a functional strut, wherein the connecting strut is connectable to the functional strut.

10. An arrangement having a transport aid device as claimed in claim 1 and having one or two pallets, wherein the first support device and the second support device are in each case mechanically connected, by way of the connecting element thereof, to the first pallet.

11. An arrangement having a transport aid device as claimed in claim 1 and having a pallet, wherein the first support device lies on the loading base of the pallet, and the second support device lies on the first support device, and the two support devices are detachably mechanically connected to the pallet.

12. A transport aid device for at least two pallets, wherein the pallets each include a loading base which is oriented substantially horizontally in a usage condition during transport, the transport aid device comprising:

a first support device and a second support device spaced therefrom for supporting at least one of the pallets, each of the support devices comprising:

a planar body including two spaced support beams which transition from a base section, wherein, in the usage condition during transport, the two support beams extend substantially in a vertical direction and each includes a first end which, in the usage condition during transport, forms the upper end of the respective support beam, each support beam comprising a bottom plate co-planar with the base section and a stiffening rib protruding from the bottom plate, at least one first connecting element for a mechanical connection of the support device to a first pallet, and a holding element connected to the first end of each of the two support beams, wherein each holding element in the usage condition during transport of the two pallets, is provided for holding or supporting a second pallet which is vertically spaced from the first pallet.

13. The transport aid device as claimed in claim 12, including a second connecting element protruding from the bottom plate, wherein the second connecting element in the usage condition during transport has a vertical spacing from the at least one first connecting element of the same body, wherein a section of the first pallet can be mechanically received between the first and second connecting elements.

14. The transport aid device as claimed in claim 13, wherein at least one of the first and second connecting elements and the holding element includes a support surface which bears against a loading base of one of the pallets, and a stiffening limb, which is angled relative to the support surface and which serves for stiffening the connecting element.

15. The transport aid device as claimed in claim 12, further comprising a connecting strut including at least one of a metal profile, a tensile bar, a cable, a chain, a strap and a belt, and wherein a stiffening rib of at least one of the support beams includes a mechanical connecting element for mechanical connection to the connecting strut.

16. The transport aid device as claimed in claim 12, further comprising a stabilizing strut for connecting the two support beams of at least one of the support devices to each other.

17. A transport aid device for first and second pallets, wherein the pallets each include a horizontally oriented loading base in use, the transport aid device comprising:

a first support device and a second support device spaced from the first support device, wherein each of the first and second support devices comprises:

a unitary planar body including two spaced support beams extending away from a base section, wherein the body is oriented in a substantially vertical direction in a use condition, each support beam including a bottom plate which is co-planar with the base section and a stiffening rib extending away from the bottom plate, a first connecting element protruding from the base section, the first connecting element being adapted to connect to the first pallet, and a holding element connected to an upper end of each of the two support beams, wherein the holding element is adapted to support the second pallet.

18. The transport aid device as claimed in claim 17, further comprising a second connecting element protruding from the bottom plate, wherein the second connecting element in the usage condition during transport is vertically spaced from the first connecting element, wherein a section of the first pallet can be mechanically received between the first and second connecting elements.

19. The transport aid device as claimed in claim 18, wherein at least one of the first and second connecting elements and the holding element includes a support surface which bears against a loading base of one of the pallets, and a stiffening limb, which is angled relative to the support surface and which serves to stiffen the connecting element.

20. The transport aid device as claimed in claim 17, further comprising a stabilizing strut for connecting the two support beams of at least one of the first and second support devices to each other.

* * * * *